US011833525B2

(12) United States Patent
Doppstadt

(10) Patent No.: US 11,833,525 B2
(45) Date of Patent: Dec. 5, 2023

(54) METHOD AND APPARATUS FOR SEPARATING FEED MATERIAL

(71) Applicant: LIG GmbH, Velbert (DE)

(72) Inventor: Ferdinand Doppstadt, Velbert (DE)

(73) Assignee: LIG GmbH, Velbert (DE)

( * ) Notice: Subject to any disclaimer, the term of this patent is extended or adjusted under 35 U.S.C. 154(b) by 131 days.

(21) Appl. No.: 17/440,272

(22) PCT Filed: Mar. 16, 2020

(86) PCT No.: PCT/EP2020/057061
§ 371 (c)(1),
(2) Date: Sep. 17, 2021

(87) PCT Pub. No.: WO2020/187826
PCT Pub. Date: Sep. 24, 2020

(65) Prior Publication Data

US 2022/0152627 A1 May 19, 2022

(30) Foreign Application Priority Data

Mar. 20, 2019 (DE) ..... 10 2019 001 907.5

(51) Int. Cl.
*B03C 1/20* (2006.01)
*B03C 1/12* (2006.01)
(Continued)

(52) U.S. Cl.
CPC ..... *B03C 1/20* (2013.01); *B03C 1/12* (2013.01); *B03C 1/16* (2013.01); *B03C 1/247* (2013.01); *B03C 2201/20* (2013.01)

(58) Field of Classification Search
CPC .... B03C 1/30; B03C 1/12; B03C 1/20; B03C 1/16; B03C 1/247; C03C 2201/20
See application file for complete search history.

(56) References Cited

U.S. PATENT DOCUMENTS 5,394,991 A * 3/1995 Kumagai ..... B03C 1/247 209/212
5,746,320 A * 5/1998 Fujita ..... B03C 7/10 209/127.4
(Continued)

FOREIGN PATENT DOCUMENTS

CN 109201331 A 1/2019
GB 1530065 A 10/1978
WO WO 2012/121438 A1 9/2012

OTHER PUBLICATIONS

International Search Report for International Application No. PCT/EP2020/057061, dated Jun. 30, 2020.
(Continued)

*Primary Examiner* — Patrick H Mackey
(74) *Attorney, Agent, or Firm* — Jason H. Vick; Sheridan Ross, PC

(57) ABSTRACT

The invention relates to a method for separating feed material, wherein the feed material comprises at least one ferromagnetic material fraction and a non-ferrous material fraction, wherein a conveying stream is fed to a first separation of a first ferromagnetic material fraction, in particular by means of a first magnetic separating device (1), wherein the conveying stream is subsequently fed to a second separation of a second ferromagnetic material fraction from the conveying stream, in particular by means of a second magnetic separating device (2), and wherein a redistribution and/or reallocation of the material of the conveying stream takes place between the first separation and the second separation.

24 Claims, 10 Drawing Sheets

Figure 1:
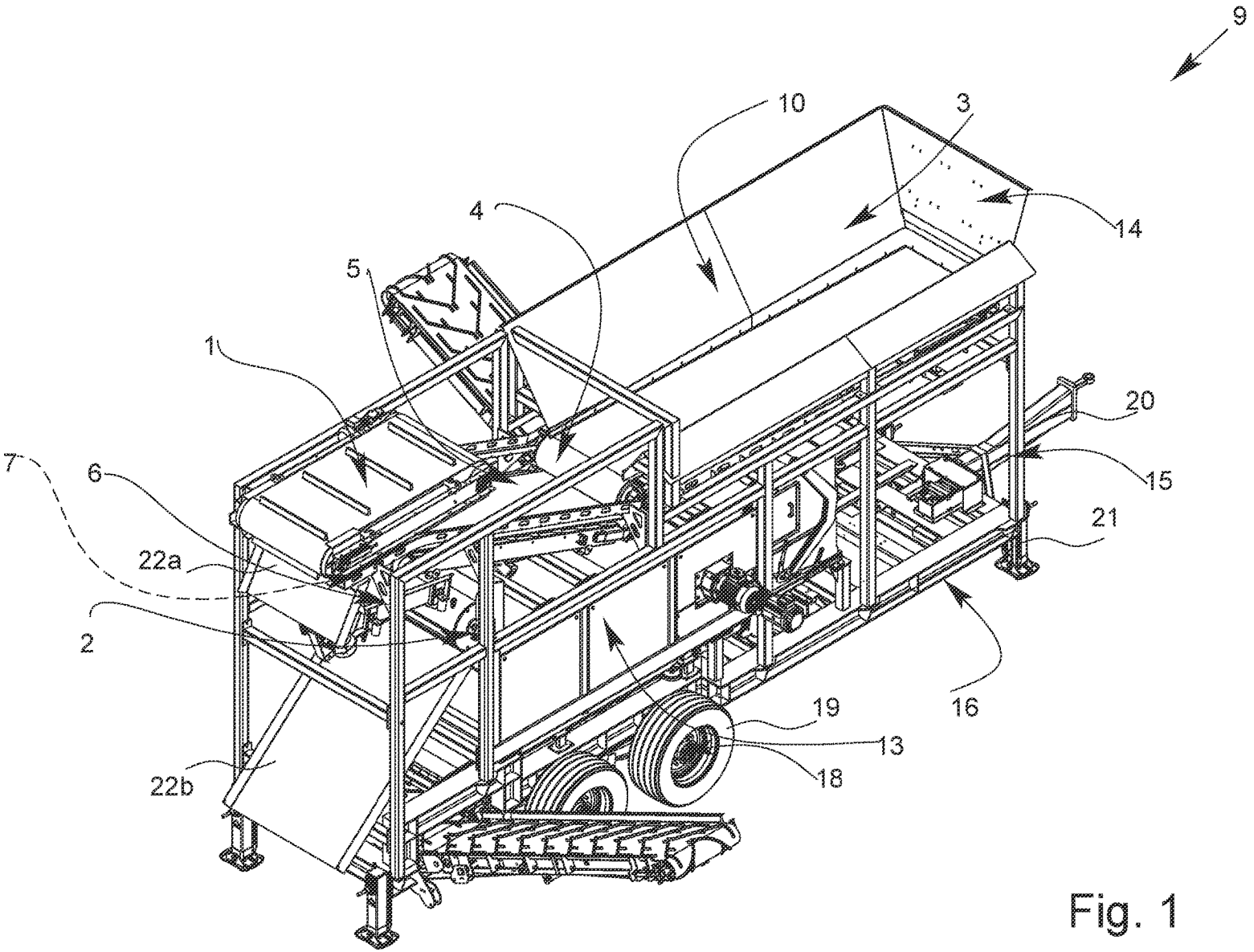

(51) Int. Cl.
*B03C 1/16* (2006.01)
*B03C 1/247* (2006.01)

(56) References Cited

U.S. PATENT DOCUMENTS

| | | | | |
|---|---|---|---|---|
| 7,770,735 | B2 * | 8/2010 | Phillip | C01D 7/126 209/40 |
| 9,033,157 | B2 * | 5/2015 | Berkhout | B07B 13/16 209/696 |
| 9,327,292 | B2 * | 5/2016 | Yamamoto | B04C 9/00 |
| 9,463,469 | B2 * | 10/2016 | Morris | B03C 1/18 |
| 10,682,652 | B2 * | 6/2020 | Yamamoto | B07B 11/06 |
| 11,590,513 | B1 * | 2/2023 | Brown | B07C 5/3422 |
| 2017/0232446 | A1 | 8/2017 | Hillis et al. | |

OTHER PUBLICATIONS

Written Opinion for International Application No. PCT/EP2020/057061, dated Jun. 30, 2020.

* cited by examiner

METHOD AND APPARATUS FOR SEPARATING FEED MATERIAL

CROSS-REFERENCE TO RELATED APPLICATIONS

This application is a national stage application under 35 U.S.C. 371 of PCT Application No. PCT/EP2020/057061 having an international filing date of 16 Mar. 2020, which designated the United States, which PCT application claimed the benefit of German Application No. 10 2019 001 907.5, filed 20 Mar. 2019, each of which are incorporated herein by reference in their entirety.

The present invention relates to a method for separating feed material, wherein the feed material comprises at least a ferromagnetic material fraction and a non-ferrous material fraction (that is, a non-ferrous, in particular metallic, material fraction and/or a non-ferromagnetic material fraction).

The aforementioned material fractions are to be understood in particular as comprising ferrous and/or ferromagnetic and/or non-ferrous feed material particles or components. In this context, the aforementioned ferromagnetic feed material particles and/or components of the ferromagnetic material fraction do not have to comprise a ferromagnetic material, but may in particular comprise the same. A conveying stream, which is composed of the material fractions to be separated and the "residual fraction", is guided through the individual method steps in the conveying direction.

The conveying stream is fed to a first separation of a first ferromagnetic material fraction, in particular by means of a first magnetic separating device. Subsequently, the conveying stream is fed to a second separation of a second ferromagnetic material fraction from the conveying stream, in particular by means of a second magnetic separating device. Accordingly, a two-stage separation of the ferromagnetic material fractions is provided.

Furthermore, the present invention relates to an apparatus for carrying out the aforementioned method, the apparatus comprising a first magnetic separating device for separating a first ferromagnetic material fraction and a second magnetic separating device for secondly separating a second ferromagnetic material fraction.

In the field of processing reusable metallic material fractions, methods and apparatuses are known which separate ferromagnetic material fractions from a conveying stream. Both the apparatus and the method can be used for processing mixed waste comprising a high proportion of reusable, preferably lumpy, metallic material fractions. A subsequent recycling of the material fractions ultimately requires an at least substantially accurate and/or unmixed separation of the ferromagnetic material fractions.

The methods and apparatuses known in practice for separating ferromagnetic material fractions from feed material are associated with a large number of disadvantages. For example, at a higher throughput rate, there is usually no effective separation of the ferromagnetic material fraction, so that even the conveying stream already passing through the method still contains a non-negligible proportion of ferromagnetic components. A reliable separation of these components cannot be sufficiently guaranteed due to the low efficiency of the known separation method of the ferromagnetic material fractions.

Furthermore, a sufficient economic efficiency through reuse of the ferromagnetic material fraction is not given with the currently known magnetic separation methods, since ultimately the operating and process costs usually exceed the profits that can be achieved through the reuse of the separated ferromagnetic material fractions. However, due to legal requirements with regard to the treatment of waste, the processes have to be carried out.

Further, the apparatus known in the art for carrying out the method is bulky and ultimately takes up a lot of space, so that sufficient space is required for the known apparatus.

In order to achieve an effective and/or selective separation of the ferromagnetic material fractions, it is usually necessary to pass the feed material through the aforementioned method at least twice, which on the one hand increases the process time required for the separation and on the other hand increases the operating costs.

It is now the task of the present invention to avoid the aforementioned disadvantages of the prior art, or at least to substantially reduce them. In particular, it is the task of the present invention to increase the degree of separation of the ferromagnetic material fractions from the feed material in a single method run.

According to the invention, the aforementioned task is in particular at least substantially solved in that a redistribution and/or a reallocation of the material of the conveying stream takes place between the first separation and the second separation.

A redistribution of the material of the conveying stream is to be understood in particular in such a way that a mixing of the material of the conveying stream takes place between the first separation and the second separation. Finally, a "turning upside down" of the material of the conveying stream may be provided.

Preferably, a conveying device may be provided for feeding to the first separation, wherein the conveying device may transfer the conveying stream to a further conveying device. In particular, a redistribution and/or a reallocation of the material of the conveying stream can be effected by the design and/or the arrangement of the conveying device and the further conveying device.

In the case of a redistribution of the material of the conveying stream, those "lower" constituents of the material of the conveying stream which at least substantially face the conveying device can be arranged at least partially in the "upper" region of the conveying stream—seen in cross-section, in particular transversely to the conveying direction—on the further conveying device.

Provided, for example, that there is a layering of the material of the conveying stream, a reallocation of the material of the conveying stream may contribute to the fact that at least one "lower" layer, in particular the lowermost layer, of the conveying stream conveyed along the conveying device forms an "upper" layer, in particular the uppermost layer, of the conveying stream conveyed along the further conveying device after transfer to the further conveying device. The lower layer may face the conveying device—as seen in cross-section, in particular transversely to the conveying direction—while the upper layer may face away from the further conveying device—as seen in cross-section, in particular transversely to the conveying direction.

In a layering of the conveying stream, a distinction can be made between upper layers, facing away from the conveying device and/or the further conveying device, and lower layers, in particular facing the conveying device and/or the further conveying device, which are separated from each other by a central plane. The central plane may extend centrally through the cross-section of the conveying stream. In particular, the central plane is oriented, at least in sections, along the conveying direction and/or divides the conveying stream, in particular along the conveying direction, into an upper and a lower part. Furthermore, the central plane is preferably perpendicular to the cross-section of the conveying stream, which is oriented transversely to the conveying direction.

Ultimately, there can also be a mixing of the layers during the redistribution, whereby the aforementioned redistribution basically remains.

In particular, the layers can be mirrored along the median plane—as seen in the cross-section of the conveying stream, especially transversely to the conveying direction.

It is preferred that the conveying stream, at least in the region between the first and the second separation and/or at least in sections within the method, is guided as a single conveying stream. This is advantageous for a simply guided method involving a high efficiency of the second separation.

Preferably, the redistribution and/or the reallocation does not take place in and/or not in the vicinity of and/or not with the aid of a screening, a sifting and/or an eddy current separation (and/or a corresponding means, a corresponding apparatus and/or a corresponding apparatus for carrying out the respective method step). It may also be provided that, for example, immediately before and/or after and/or during the redistribution and/or the reallocation, no comminution of constituents of the conveying stream is provided. Thus, the redistribution and/or the reallocation can be carried out in a very repeatable and defined manner if the aforementioned influences are deliberately kept away, in order to make the result of the first and the second separation at least substantially predictable and/or continuous.

Furthermore, both the reallocation and the redistribution enable, in particular, small ferromagnetic constituents and/or particles of the feed material which could not be captured by the first separation to be separated by the second separation. By a redistribution and/or reallocation of the material of the conveying stream, in particular a mixing and/or reversal of the material flow, those ferromagnetic constituents and/or particles of the material of the conveying stream which could not be separated by the first separation due to their lower arrangement facing the conveying device can be captured by the second separation. Thus, sufficient access to ferromagnetic constituents and/or particles of the entire cross-section of the conveying stream, in particular transversely to the conveying direction, is ensured according to the invention.

According to the invention, a high proportion of reusable, recovered ferromagnetic material fractions can be obtained from the feed material, while at the same time the economic efficiency of the entire recycling process can be ensured. Consequently, in particular legal requirements can be fulfilled from an economic point of view. Moreover, the method according to the invention enables a high ecological compatibility. Preferably, a renewed passage of "the residual fraction" of the extracted material which has not been separated can be avoided.

The "residual fraction" is made up of the non-separated—"leftover"—material fraction. Non-ferromagnetic metal components can subsequently be removed from the "residual fraction" resulting after the first and second separation.

According to the invention, a selective recovery of valuable material from the metallic fractions can be made possible, which in particular enables a high grade purity of the various metallic fractions. Up to now, this has not been possible in the prior art. If metallic separation has taken place at all, this has been due to legal requirements and/or the separation of impurities. The impurities would otherwise impair subsequent method steps. However, in connection with experiments according to the invention, it could be demonstrated that the targeted recovery of valuable materials can be used profitably as such.

Preferably, the efficiency of the ferromagnetic separation of the ferromagnetic material fractions from the feed material is increased by up to 70% compared to the state of the art. In addition, a high grade purity of the separated individual fractions can be ensured, which is particularly advantageous in the case of metals and their reuse. This ensures that the metals can be economically reused.

In particular, the first separation is configured to provide a very high degree of separation for larger constituents of the ferromagnetic material of the conveying stream. Larger constituents may be understood as rods, elongated constituents and/or constituents with a weight of more than 200 g and/or with a volume of at least $(1 \cdot 10^{-3})$ $m^3$.

During the second ferromagnetic separation, in particular small components which are smaller and/or lighter than the larger components of the conveying stream separated with the first separation can be separated. Preferably, the second separation takes place via a contacting surface. Advantageously, the second ferromagnetic separation is designed in such a way that the ferromagnetic components of the conveying stream which cannot be detected or can only be detected incompletely by the first separation, in particular by means of the first magnetic separating device, can be separated in a targeted and purposeful manner. This ultimately increases the degree of separation of the ferromagnetic material fraction, in particular with only a single method run.

Furthermore, the redistribution and/or the reallocation of the material makes it possible to ensure a compact design of the apparatus carrying out the method. In particular, the solution according to the invention makes it possible to reduce the space required for the apparatus carrying out the method by at least 20% and/or by up to 60% compared to apparatuses known from the prior art. Preferably, a compact arrangement of the apparatus is thus made possible.

In a particularly preferred embodiment of the method, the feed material is fed into a metering hopper device. In particular, the feed material is fed before the first separation. Ultimately, the feed material can be temporarily stored—that is, stored and/or bunkered —in the metering hopper device and, in particular, can also be fed to the first separation in adjustable fractions. Advantageously, the feed material can be fed not only from above, but alternatively and/or cumulatively laterally to the metering hopper device, "laterally" being understood to mean the longitudinal extent of the apparatus carrying out the method. Ultimately, the feed material can be supplied to the metering hopper device in different ways.

The feed material can be crushed before being fed to the metering hopper device, so that an effective separation of individual, separable and isolatable material particles of the feed material can be ensured.

Furthermore, the material to be conveyed can be transferred as a conveying stream from the metering hopper device onto and/or to a metering device, in particular a belt feeder, preferably a hopper discharge belt. The conveying stream can be conveyed and/or transported along the metering device.

In particular, the conveyed material is discharged from the metering hopper device via at least one metering opening onto the metering device. Finally, the metering device can transport the conveyed material out of the metering hopper device.

Preferably, the conveyed material can be fractionated, equalized and/or separated by means of a metering means, for example a pusher and/or a metering roller, before being transferred to the metering device.

Particularly preferably, the conveying stream is fed to the first separation via a conveying device. The conveying device may be an accelerating belt. In particular, the conveying stream can be transferred from the metering device to the conveying device. Furthermore, the conveying stream can be equalized in the conveying direction by means of the conveying device, whereby in particular a material separation of the conveying stream takes place. This can increase the degree of separation of the first separation.

Preferably, the conveying stream is weighed on the conveying device at least in some areas, in particular with a belt weigher. The measurement results can be used to control and/or regulate the method and/or the apparatus.

Preferably, the speed of the conveying device is greater than the speed of the metering device, in particular by at least 20%, preferably between 100% and 500%. Consequently, the conveying stream can be "accelerated" by transfer from the metering device to the conveying device.

In particular, the conveying device is operated at such a conveying speed that, when the material to be conveyed is discharged from the conveying stream, a throwing parabola of between 5 and 50 cm is produced, in particular in horizontal width.

Preferably, the metering device has a belt speed, in particular an adjustable belt speed, of about 0.01 m/s. Further preferably, the conveying device may have a belt speed of greater than 1 m/s, preferably between 2 to 4 m/s, more preferably between 2.5 to 3 m/s.

Moreover, in a further embodiment of the invention, the conveying stream may be fed to the second separation via a further conveying device, preferably a vibrating chute.

The further conveying device may vibrate and/or oscillate. In principle, however, the further conveying device can also be designed as a conveyor belt.

The further conveying device, which is preferably in the form of a vibrating chute, can be provided for continuously feeding the second magnetic separating device carrying out the second separation. In this case, the material of the conveying stream is continuously conveyed further by means of vibrations of the further conveying device, in particular in a determinable rhythm.

When a conveying stream is transferred from the conveying device to the further conveying device, for example, the redistribution and/or the reallocation may be provided. The redistribution and/or the reallocation may occur in such a way that components of the conveying stream, which are at least substantially closer to the conveying device than others, further components of the conveying stream are at least substantially further away from the further conveying device after the redistribution and/or the reallocation than the other, further components of the conveying stream. Indeed, the other, further components of the conveying stream are then arranged closer to the further conveying means after the redistribution and/or the reallocation. This mode of operation causes that the second separator, due to the preferably provided redistribution, can operate more effectively and can separate better than it would be the case without redistribution and/or without reallocation.

The redistribution and/or reallocation of the conveying stream according to the invention is understood to mean, in particular, a particularly structured and repetitively accurate redistribution and/or reallocation. For this purpose, in particular an arrangement of the at least two conveying devices relative to one another and/or a guidance of the conveying stream on and/or between the conveying device and the further conveying device is provided. Ultimately, the redistribution—and/or also the reallocation—can take place during the belt transfer between two conveyor belts.

Basically, it can be provided that during the redistribution and/or the reallocation of the conveying stream, the material of the conveying stream is transferred or handed over from the conveying device to the further conveying device in such a way that a targeted change in the local arrangement of the components of the conveying stream is achieved. In particular, the purpose of the redistribution and/or the reallocation is that components of the conveying stream, which before the redistribution and/or before the reallocation were covered and/or buried under further components of the conveying stream, after the redistribution and/or after the reallocation at least substantially emerge, are arranged closer to the surface of the conveying stream and/or are ultimately no longer covered and/or no longer buried.

Preferably, the redistribution and/or the reallocation is a repeatable step in the method according to the invention. This means that the redistribution and/or the reallocation always causes an identical change in the material arrangement within the cross-section of the conveying stream, in particular transversely to the conveying direction, when the state before and after are compared. In particular, of course, this applies to the case where the cross-section of the incoming conveying stream, in particular transversely to the conveying direction, has at least substantially a constant or continuous arrangement when observed and/or viewed at a point by a conveying device over time.

Ultimately, according to the invention, it is particularly noteworthy during the reallocation and/or during the redistribution that the conveying stream is not simply transferred between two conveying devices in an uncontrolled manner or also at least approximately in an unguided manner, but that special precautions are taken with regard to the belt transfer and/or the transfer between two conveying devices. This may be, for example, an arrangement of two conveying devices, in particular the conveying device and the further conveying device, at an angle and/or at a certain distance from each other. For example, the conveying stream can be transferred from an accelerating belt to a vibration chute while performing the reallocation and/or redistribution in a defined manner.

Alternatively or additionally, it may be provided that the second separation is carried out while the conveying stream is conveyed along the further conveying device. In particular, the second separation can be carried out at the end, preferably facing away from the belt transfer, of the further conveying device. In this respect, the second magnetic separating device can be arranged in and/or on the further conveying device, in particular wherein the second magnetic separating device is configured as a magnetic deflection roller. Preferably, the second separation is thus carried out when the belt is ejected from the further conveying device.

Particularly advantageously, stainless steel particles of the conveying stream are also separated with or in the second ferromagnetic material fraction during the second separation.

Finally, it may also be provided for the first separation to take place during transport of the conveying stream in the conveying direction of the conveying device, in particular analogously to the second separation described above. For example, at the end, facing away from the metering device, at the belt end of the conveying device, the second magnetic separating device may be arranged and/or integrated into the conveying device. In this case, the first magnetic separating device can be designed as a deflection roller. Accordingly, the first separation can be carried out during the belt discharge from the conveying device onto the further conveying device.

For further separation of the first and/or second material fraction, at least one separating means, in particular a, preferably angular, separating plate, can be arranged in the region of the discharge of the conveying stream, which divides the first and/or the second material fraction into sub-material fractions with different magnetic properties. Very preferably, for example, the stainless steel particles, which have lower ferromagnetic properties than the iron particles, can thus be extracted from the second material fraction. Accordingly, a further fractionation of the first and/or second material fraction can be effected by the separating means preferably formed as a separating apex plate.

In particular, the conveying stream is transferred from the conveying device onto or to the further conveying device, wherein the first separation may be arranged in the area of the belt transfer between the conveying device and the further conveying device.

The conveying direction of the conveying device may extend at an angle $\alpha$ of greater than 90° to the conveying direction of the further conveying device, preferably between 100° and 210°, more preferably between 110° and 190°. Finally, the conveying direction of the conveying device may be at least substantially opposite to the conveying direction of the further conveying device. Such an arrangement of the conveying directions allows, in particular, a reallocation and/or redistribution of the material of the conveying stream and, at the same time, a compact design of the device carrying out the method. In particular, a reversal of the material flow and/or stream is thus produced, in particular wherein the vibrations of the further conveying device can ensure a further loosening and/or equalization of the material of the conveying stream along the conveying direction of the further conveying device.

Particularly preferably, a contact separation takes place during the second separation by the second magnetic separating device integrated and/or arranged on and/or in the further conveying device, preferably a magnetic deflection roller. Due to the contact separation, the second ferromagnetic material fraction can ultimately adhere to the conveyor belt of the further conveying device and thus be separated.

Preferably, the conveying stream is discharged from the conveying device onto the further conveying device, which may allow further redistribution and/or reallocation of the material of the conveying stream.

Particularly preferably, the first separation takes place in the region of the belt transfer from the conveying device to the further conveying device. In particular, the first separation also takes place during the discharge of the conveying stream from the conveying device to the further conveying device. The first ferromagnetic material fraction can thereby be separated by the first magnetic separating device, which is preferably in the form of an overband magnetic separator, in such a way that it can be drawn out of the conveying stream at least substantially by the acting magnetic forces.

In a further preferred embodiment of the present invention, the conveying stream is discharged from the further conveying device onto the second magnetic separating device. In this regard, it may be provided that the second magnetic separating device rotates and comprises a contactive surface to which the ferromagnetic second material fraction may adhere. In particular, the second magnetic separating device is configured as a rotating magnetic drum (magnetic separation roller), on the outer surface of which the conveying stream impinges by being ejected from the further conveying device.

In principle, however, it is also possible to design the second magnetic separating device in accordance with the first magnetic separating device, i.e. in particular as an overband magnetic separator. In this case, the above explanations apply with regard to the arrangement and separation.

In a further particularly preferred embodiment of the method according to the invention, a third separation of a non-magnetic and electrically conductive third material fraction from the conveying stream takes place. In particular, the third material fraction comprises non-ferrous metals—that is, non-magnetic and non-ferrous metals.

Very preferably, the third separation is designed in such a way that at least two fractions of the non-ferrous metals can be separated. In particular, light metals, copper, brass and/or bronze particles and/or stainless steel, in particular residues of stainless steel, comprising components of the material of the conveying stream can be provided as non-ferrous metals. Preferably, in particular aluminum and/or copper and/or brass and/or bronze can be separated at least substantially separately.

The third separation can take place in the direction of the process and/or in the direction of conveyance downstream of the second separation. Ultimately, the third separation can therefore be fed to the conveying stream which has already been at least substantially freed from the ferromagnetic material fractions. In particular, the third separation is carried out by means of an eddy current separator—also referred to as "eddy current"—and/or an eddy current separating device, which is in particular designed in such a way that an alternating magnetic field is generated. Consequently, eddy currents perpendicular to the alternating magnetic flux can be generated within the material of the conveying stream, which in turn build up magnetic fields that are opposed to the inducing fields. This leads to a repulsive force effect (also called Lorenz force). The electrically conductive components of the material of the conveying stream are ejected from the front or top in the direction of travel of a conveyor, in particular a conveyor belt, by the magnetic force effect and can be collected. A non-electrically conductive residual fraction may be discharged downwardly at the end of the conveying means in a discharge parabola unaffected by the magnetic field. Finally, a non-conductive residual fraction, which preferably comprises at least substantially no metals, can be separated.

According to the invention, it has been recognized that the method according to the invention for the separation of ferromagnetic components can be used particularly advantageously in combination with an eddy current separation. In practice, it is ultimately the case that for the eddy current separation a very effective and in particular at least substantially complete separation of ferromagnetic components must be ensured before the conveying stream is supplied to the eddy current separation. However, if the feed material has ferromagnetic components in a non-negligible proportion, the method reliability of the third separation cannot be adequately guaranteed. This bears the risk—as has been established at the time of the invention—that the eddy current separation is not only disturbed by the ferromagnetic portions, but also that a safe operation of the eddy current separating device cannot be ensured. A non-negligible proportion of ferromagnetic components in the conveying stream fed to the eddy current separation can ultimately cause the risk of melting of the conveyor belt up to and including a fire, in particular on the conveyor belt.

By means of the method and the apparatus according to the invention, it is possible to ensure such a separation of the ferromagnetic components by type before they are fed to the third separation—i.e. the eddy current separation—that the necessary method reliability of the entire plant and/or of the method can also be ensured. Thus, a very advantageous aspect in terms of safety results, which is ultimately also linked to operating and plant costs which can be saved. The conveying stream supplied to the third separation according to the invention is at least substantially free of ferromagnetic components, so that the eddy current separation method can be carried out at least substantially without ferromagnetic impurities in this respect.

Furthermore, a fourth separation of a fourth fraction of material may be carried out by means of an air separator. In this context, it is understood that the fourth separation may also be carried out several times and in particular at different points of the method. In particular, the fourth separation may take place after the first separation and before the second separation—as seen in the direction of the process. Preferably, the fourth separation can take place in the region of the belt transfer and/or the discharge of the conveying stream onto the further conveying device.

Alternatively or additionally, the fourth separation may be provided downstream of the third separation in the conveying direction. In this context, the fourth separation may be provided both for the non-electrically conductive residual fraction of the conveying stream and/or for the at least one non-ferrous material fraction (that is, the at least one third material fraction).

The air separator enables particles to be separated on the basis of their ratio of inertia and/or gravity to flow resistance in a gas and/or air flow, in particular film remnants are separated. Thus, within the framework of this classification process, the respective flow behaviour of the particles and/or their density is ultimately exploited. In particular, the air separator is provided for separating light particles, such as film remnants or the like. This enables an improved selectivity of the non-ferrous fraction separated from the method.

Alternatively or additionally, it can be provided that the fourth separation is provided downstream of the third separation for a second method run, in which in particular only the third material fraction of a first method run is treated again, in particular for the separation of film residues. For example, the discharge behaviour of the eddy current separating device can be used for this purpose. A second method run of the third material fraction (non-ferrous fraction) can be provided for post-purification and, in particular, can be carried out with a significantly reduced proportion as required by metering from the metering hopper device, preferably during a night shift.

In the second method run and/or in the post-cleaning, it is particularly advantageous if this is carried out with significantly reduced operating parameters, in particular a significantly reduced speed of the respective conveying devices. During post-cleaning, in particular crumbly and/or smaller components in different non-ferrous metal fractions are separated. Therefore, the operating parameters, such as speed and/or rotational speed of process drums, can be adjusted in greatly changed composition of the total fraction, so that the separation efficiency can be increased. Particularly preferably, the second method run is carried out at a speed reduced by up to 50% and/or by up to 75% compared to the regular speed of the conveying means during the "regular" method run. In particular, it is provided that the average throughput speed of the conveying devices during the post-cleaning corresponds to 20% to 40% of the regular average throughput speed of the conveying devices during the "regular" method run. In particular, the post-cleaning is provided for feeding the conveying stream to the eddy current separation and/or to the third separation.

According to the invention, the overall method sequence enables the treated and, in particular, separated material fractions to be further used as metallic recyclable material fractions, so that economical operation is made possible.

In a further preferred embodiment, it is provided that the passage cross-section of the material of the conveying stream becomes wider and/or expands in the conveying direction along the method steps, preferably conically. Preferably, an expansion of the passage cross-section by at least 10%—with respect to the ratio of the initial passage cross-section to the final passage cross-section—is provided. Finally, an expansion of at least 5% may preferably be provided from one stage to the next stage, although an expansion need not be provided at each stage. This improves the separation efficiency and/or the degree of separation of the individual material fractions.

Furthermore, the present invention relates to an apparatus for carrying out the method according to any of the preceding embodiments.

The apparatus is provided for separating feed material. The feed material may comprise at least one ferromagnetic material fraction and at least one non-ferrous material fraction (that is, a non-magnetic and/or non-ferrous material fraction). According to the invention, the apparatus comprises a first magnetic separating device for first separation of a first ferromagnetic material fraction and a second magnetic separating device for second separation of a second ferromagnetic material fraction.

In the sense of the invention, a first and/or second magnetic separating device is a device for separating and/or removing ferromagnetic materials and/or a material fraction, in particular in the form of piece goods and/or bulk material, from other, non-ferromagnetic materials and/or from a non-ferromagnetic residual fraction. Typically, a first and/or second magnetic separating device employs a permanent magnet and/or an electromagnet which, with the aid of its magnetic field, can attract at least approximately exclusively ferromagnetic components of the conveying stream. In particular, a first and/or second magnetic separating device is to be understood as one which can separate ferromagnetic material fractions from the conveying stream, but not non-ferromagnetic material fractions such as, for example, a non-ferrous material fraction with non-ferrous metals.

Further, the apparatus comprises a conveying device for supplying the conveying stream to the first magnetic separating device and a further conveying device for supplying the conveying stream to the second magnetic separating device, wherein the conveying device and the further conveying device are arranged such that a redistribution and/or reallocation of the material of the conveying stream takes place between the first magnetic separating device and the second magnetic separating device.

Preferably, the conveying device and the further conveying device are arranged in such a way that the conveying direction of the conveying device extends at an angle $\alpha$ of greater than 90° to the conveying direction of the further conveying device, preferably between 100° to 210°, more preferably between 110° to 190°.

In connection with the method according to the invention, it is understood that the advantages and particular embodiments of the method according to the invention mentioned above also apply in the same way to the apparatus according to the invention. In order to avoid unnecessary repetitions, reference may be made to the preceding remarks with regard to explanations in this respect.

A redistribution and/or reallocation of the material of the conveying stream is to be understood in particular as a reversal of the material flow. In this context, those lower particles of the conveying stream which face the conveying device can be arranged in the upper region—facing away from the further conveying device—of the conveying stream at the further conveying device after the transfer.

Thereby, not all particles and/or constituents of the material of the conveying stream which have been arranged on the lower side of the conveying stream need to be arranged on the upper side of the conveying stream on the further conveying device. According to the invention, this is ultimately provided in particular for a larger proportion, preferably of at least 50%, further preferably between 60 to 95%, of the lower particles and/or constituents.

By means of the apparatus according to the invention, an improved mixing, presentation for physical separation methods and/or loosening up of the material of the conveying stream is effected, in particular by the design of the belt transfer between the conveying device and the further conveying device according to the invention.

Moreover, according to the invention, a compact design, in particular a longitudinal design, of the apparatus is made possible.

In a particularly preferred embodiment, the apparatus is designed as a mobile unit. A mobile unit is understood to be a, preferably road-mobile, movable unit which can be used for different locations. According to the invention, the mobile unit enables the apparatus to be used in particular directly at the location where the feed material to be separated accumulates and/or is further processed. Consequently, no location-bound apparatus is necessary, which results in a high flexibility for the user. Furthermore, costs can also be saved, since in particular a costly transport of the feed material to a stationary separating device can be omitted. The arrangement of the conveying device and the further conveying device according to the invention can ensure the compact and, in particular, road-mobile unit of the apparatus.

Preferably, a metering hopper device is provided which may serve to store and/or receive the feed material. The metering hopper device may have an at least substantially cuboidal shape. However, other shapes of the metering hopper device are also possible according to the invention. The metering hopper device may comprise a feed opening for feeding the feed material, which is usually directed upwards, so that feeding from above is possible. Furthermore, the feed material can also be fed to the metering device via a conveyor belt. Feeding of the feed material can also be carried out by excavators, for example.

It is also conceivable that the apparatus is associated with a comminution device which feeds the comminuted material as feed material to the apparatus according to the invention. In this context, it would be particularly possible that the metering hopper device is provided for equalizing the material and/or for metering and/or fractionating the feed material.

Furthermore, the metering hopper device may comprise at least one, in particular adjustable, metering opening. In particular, an opening whose opening cross-section is adjustable may be provided as a metering opening. The metering opening may be arranged opposite the feed opening, in particular in the bottom region of the metering hopper device.

Particularly preferably, the metering hopper device has a volume for the feed material of between 1 to 20 $m^3$, more preferably from 3 to 10 $m^3$.

Furthermore, at least one side wall can be designed as a, preferably pivotable, flap which can be swung open for feeding the material. Furthermore, the metering hopper device can be designed in such a way that a longitudinal orientation in the material flow direction and/or in the conveying direction can be produced. Preferably, this is made possible by an elongated design of the metering hopper device and/or by the corresponding arrangement of the flap wall, in particular wherein the length of the metering hopper device is designed to be greater than the width by at least 50%, preferably between 70 to 900%.

In a further preferred embodiment, a metering device, preferably a belt feeder, in particular a hopper discharge belt, is provided. The metering device may be arranged at least regionally below the metering hopper device and provided for conveying the conveying stream. In particular, the metering device may be arranged at least regionally below the metering opening. Ultimately, the metering device may face away from the feed opening. By means of the metering device, in particular the feed material is supplied as a conveying stream—at least indirectly—to the first separation and the subsequent second separation, wherein a fractionation of the feed material can be effected by the interaction between the metering device and the metering hopper device.

Preferably, the conveying device is arranged in such a way that the conveying stream is fed from the metering device to the conveying device. In this respect, the conveying device may be designed as a conveyor belt, preferably as an accelerating belt. Finally, the conveying device may further be designed in comparison with the metering device such that it can be operated at a higher, preferably at least 50% and/or up to 500% higher, speed than the metering device. By means of the accelerating belt, an equalization and a separation of the material of the conveying stream can be achieved, whereby in particular the effectiveness of the first separation can be increased. At the same time, the increased speed of the conveyor belt causes the material of the conveying stream to be discharged with a large discharge parabola, which supports the first magnetic separation.

Finally, the acceleration band can also be used to generate and modify the "throwing parabola", which is in particular a component of the separation method.

Furthermore, the conveying device may be arranged obliquely and, preferably, convey the conveying stream upwards, away from a base on which the apparatus is "standing". An upwardly inclined arrangement of the conveying device, in which the belt end facing the metering device is closer to the base than the belt end of the conveying device facing away from the metering device, may support a compact design of the apparatus. Due to the purpose-oriented top-side space utilization and the reversal of the material flow between the conveying device and the further conveying device, the apparatus can be designed to be very space-saving. Preferably, the conveying device is arranged at an angle to an at least substantially planar, in particular flat, base of 20° to 75°. In particular, the longitudinal extension of the conveying device extends at an angle of 45°+/−10° to an at least substantially planar base surface.

Preferably, the conveying device comprises at least in some areas at least one weight measuring device, in particular a belt weigher, for determining the weight of the conveying stream and/or the throughput (in t/h). The measurement result can be used to control the apparatus, in particular to control the speed of the individual conveyor belts.

Furthermore, the first magnetic separating device may be configured as an overband magnetic separator. Preferably, the magnetic separating device has a direction of movement and/or conveying direction aligned at least substantially parallel to the conveying direction of the conveying device. The respective conveying directions of the conveying device and of the first magnetic separating device may enclose an angle of up to 45°+/−10° with respect to each other, preferably between 0° to 15°. In particular, the first magnetic separating device may be arranged above the conveying device—in particular facing away from the base. Quite preferably, the first magnetic separating device is arranged in the region of the belt transfer between the conveying device and the further conveying device and/or in the region of the belt end of the conveying device facing away from the metering device. Preferably, the first magnetic separating device may further be arranged longitudinally to the conveying direction of the conveying device.

An arrangement of the first magnetic separating device aligned along the longitudinal extension of the conveying device enables a longer "exposure time" for the first material fraction to be separated, and/or the conveying stream transported along the conveying device is exposed longer to the magnetic field generated by the first magnetic separating device, which ultimately increases the separation efficiency. In practice, an overband magnet is usually arranged transversely to the method flow, which causes a poorer separation efficiency. According to the invention, it is possible to move away from this arrangement, which was previously considered almost indispensable.

The first ferromagnetic material fraction may be separable from the transportable conveying stream along the longitudinal extension of the conveying device.

In particular, the distance between the first magnetic separating device, which is in the form of an overband magnetic separator, and the belt end of the conveying device facing the first separating device is such that the larger ferromagnetic components of the first ferromagnetic material fraction can be separated from the conveying stream.

The first magnetic separating device may have at least one material discharge means associated therewith. The material discharge means can be a component of the apparatus and/or be arranged outside the apparatus. In particular, a conveyor belt, a container and/or a chute is provided as the material discharge means. Ultimately, the first ferromagnetic material fraction may be transferable to the material discharge means via the first magnetic separating device and may be storable and/or bunkered, in particular, by means of the material discharge means and/or a further material discharge means. Furthermore, a separator of the first magnetic separating device may serve to dissolve the magnetic connection between the magnetic surface of the overband magnetic separator and the particles and/or constituents of the first ferromagnetic material fraction.

In a particularly preferred embodiment, the further conveying device is arranged in such a way that the conveying stream can be transferred from the conveying device to the further conveying device, in particular can be discharged. The further conveying device can furthermore be arranged at least in regions below the conveying device, facing the base and/or facing away from the first magnetic separating device.

Furthermore, the further conveying device may be designed as a conveyor belt or as a vibrating chute. The vibrating chute enables the transport of the conveying stream along the further conveying device by means of vibrations and leads in particular to an equalization of the material of the conveying stream and as a consequence preferably to an improvement of the degree of separation during the second separation.

The arrangement of the further conveying device on the underside supports the design of the apparatus according to the invention as a compact unit, wherein as a further effect the conveying direction of the further conveying device can be reversed to the conveying direction of the conveying device.

Furthermore, the second magnetic separating device—as previously described in connection with the first magnetic separating device—can be arranged above or alternatively at least regionally below the further conveying device, in particular facing away from the first magnetic separating device and/or facing the base. In particular, the second magnetic separating device is arranged in such a way that the conveying stream can be discharged from the further conveying device onto the second magnetic separating device. Also by this arrangement of the second magnetic separating device, a compact design of the entire apparatus, preferably with a longitudinal extension as small as possible, is made possible. Furthermore, a discharge of the material from the further conveying device onto the second magnetic separating device is advantageous with regard to an improved degree of separation and/or separation of the second ferromagnetic material fraction, in particular wherein a mixing and/or redistribution of the material of the conveying stream can be effected by means of the discharge.

Preferably, the second magnetic separating device is designed as a magnetic drum and/or separation roller, in particular a rotatable magnetic drum and/or separator roller. The magnetic drum and/or separator roller can in particular have a contacting surface which magnetically attracts the ferromagnetic second material fraction and can thus also separate it from the conveying stream. In this respect, the second magnetic separating device may comprise a second separator which is designed to release the magnetic connection between the surface of the second magnetic separating device, which is preferably in the form of a magnetic drum, and the second material fraction adhering to this surface.

At least one further material discharge means can be assigned to the second magnetic separating device. The further material discharge means can be designed analogously to the material discharge means of the first magnetic separating device. Ultimately, the further material discharge means may be configured as a chute, conveyor belt and/or container and may in particular serve to receive and/or store the second ferromagnetic material fraction.

In addition, the second magnetic separating device can be designed in such a way that ferromagnetic small parts which could not be separated via the first magnetic separating device can be separated by the second magnetic separating device. This enables a high degree of separation of the ferromagnetic portions of the feed material in the apparatus according to the invention, which is provided in particular for a single method pass of the feed material for separation. In principle, the apparatus can of course also be designed for a multiple method run, in particular with modified operating parameters, of the feed material.

In a particularly preferred embodiment of the present invention, the further conveying device is configured as a conveyor belt, wherein the second magnetic separating device can be arranged in and/or on the further conveying device. In particular, the second magnetic separating device is configured as a magnetic deflecting roller which is arranged at the end, facing away from the belt transfer from the conveying device. Accordingly, a dropping of the conveying stream onto the second magnetic separating device can be avoided and the second separation can be carried out in the conveying direction of the further conveying device. Such a design is in particular very space-saving, since ultimately two components—namely the further conveying device and the second magnetic separating device—can be combined with each other.

In this context, it is understood that an analogous design in this respect is also possible for the first magnetic separating device. Thus, the first magnetic separating device can be arranged and/or integrated at the end of the conveying device, facing away from the metering device, on and/or in the conveying device. In particular, the first magnetic separating device can also be designed as a magnetic deflection roller, so that in particular the first separation can take place during the belt transfer to the further conveying device.

In a further, very particularly preferred embodiment of the present invention, at least one separating means, in particular designed as a separating apex plate, is provided for the first and/or second stock fraction. The separating means may ultimately be formed, in particular, as an angled plate and serves to separate the first and/or second material fraction.

Ultimately, the separation means allows the first and/or second material fractions to be separated into "sub-fractions" based on their respective magnetic properties. For example, during the second separation, ferromagnetic constituents having weaker ferromagnetic properties compared to ferrous particles can be separated from ferrous constituents having stronger ferromagnetic properties. In particular, this may serve to separate a stainless steel fraction; stainless steel is only slightly ferromagnetic compared to iron.

Accordingly, a delayed ejection behaviour of the different materials can be used by the separating means in order to separate in particular ferromagnetic small parts from stainless steel small parts. In particular, the separating means can be arranged upstream of a material discharge means in such a way that the separated fractions can still be discharged via material discharge means. In particular, the separating means is arranged below—facing an underground—the conveying means and/or the further conveying means, so that the first and/or second material fraction(s) can be discharged onto the separating means.

According to the invention, a further fractionation may be enabled by the separating means.

Preferably, an eddy current separating device is provided for separating at least one non-magnetic and electrically conductive third material fraction. In particular, the eddy current separating device is designed in such a way that at least two third material fractions can be separated from the conveying stream, each of which is non-magnetic and electrically conductive.

According to the invention, the first and/or the second and/or a magnetic separating device can thus be distinguished from an eddy current separating device—also called eddy current separating device—purely in principle, since in the aforementioned magnetic separating devices preferably no alternating magnetic field is used. In the eddy current separating device, the principle is ultimately exploited that electrically conductive parts which are located in an alternating magnetic field, which is brought about, for example, by a rotating electromagnet, themselves become temporarily magnetic and can thus be moved. According to the invention, this principle is preferably not used in the first and/or the second and/or a magnetic separating device.

A third material fraction may be a non-ferrous material fraction. The non-ferrous material fraction may in particular comprise "non-ferrous metals" and/or light metals, copper, brass, bronze, stainless steel and/or aluminium as material components. In particular, it may be provided that also when the non-ferrous fraction (third material fraction) is separated, a separation is performed with respect to the material. For example, aluminium and/or brass and/or bronze and/or copper can be removed as a separate material stream and/or material fraction from the eddy current separating device.

In the course of bringing the invention to fruition, it has been found, moreover, that the separation method and/or apparatus according to the invention can be used particularly advantageously in combination with an eddy current separation and/or an eddy current separating device. This is ultimately based on the fact that an effective, in particular at least substantially complete, separation of the ferromagnetic components of the conveying stream is made possible before being fed to the eddy current separating device. The ferromagnetic separation is performed by means of the first and the second magnetic separating devices. To ensure method reliability, effective ferromagnetic separation of the material fractions from the conveying stream is required to ensure safe operation of the eddy current separating device. In the eddy current separating device, the non-ferromagnetic metal fractions can ultimately be separated. This enables a further separation of the, in particular metallic, material fractions of the conveying stream.

Furthermore, it was found during the development of the invention that in practice it is ultimately the case that—if an eddy current separating device is used in combination with an upstream ferromagnetic separation—safe operation of the entire system cannot be guaranteed. In practice, it is ultimately the case that no effective and/or at least substantially complete separation of the ferromagnetic components of the conveying stream can take place before the conveying stream is fed to the eddy current separating device. However, if a conveying stream still containing ferromagnetic material—with a non-negligible proportion—is fed to an eddy current separating device, permanent damage to the eddy current separating device and even to the entire plant, in particular as a result of a fire, cannot be reliably avoided due to the mode of action and operation of the eddy current separating device. Ultimately, the ferromagnetic components of the conveying stream in the eddy current separating device interfere with the operation of this eddy current separating device and also with the magnetic fields which are produced, wherein due to these interferences the conveyor belt of the eddy current separating device, along which the conveying stream is guided through the eddy current separating device, can become strongly heated, even to the point of a fire. In addition, there is a risk that the conveyor belt may melt, which may ultimately also cause a fire. This poses a high risk both for the employees operating the equipment and for permanent damage to the entire apparatus.

Preferably, the eddy current separating device can be designed such that it comprises a magnet system, in particular a rotor, which is made of and/or has a permanent magnet material, in particular neodymium. Alternating magnetic poles may be arranged on the circumference of the rotor, which rotate as a pole wheel. Via a conveyor belt, the conveying stream may be transported along the eddy current separating device. For separation, the conveying stream is exposed to an alternating magnetic field, wherein eddy currents perpendicular to the alternating magnetic flux are generated within the material of the conveying stream. These eddy currents in turn build up magnetic fields which are directed in the opposite direction to the inducing fields, resulting in a repulsive force effect (Lorenz force). These conductive particles (third material fraction) are ejected in the conveying direction of the conveyor belt by the magnetic force effect and ultimately collected in particular.

The eddy current separating device can be arranged in such a way that the conveying current can be transferred from the second magnetic separating device to and/or onto the eddy current separating device, in particular can be discharged. Preferably, the eddy current separating device is arranged at least in regions below the second magnetic separating device, facing away from the first magnetic separating device and/or facing the base. The conveying direction of the eddy current separating device may be at least substantially parallel and/or at a deviating angle of at most 30° to the conveying direction of the further conveying device. This further supports the compact, mobile design of the apparatus according to the invention.

Furthermore, in a further preferred embodiment of the invention, at least one air separator may be provided for separating a fourth material fraction. In this case, the air separator can be arranged in such a way that the conveying stream and/or the third material fraction can be transferred from the eddy current separating device to the air separator. Alternatively or additionally, the air separator may be arranged between the conveying device and the further conveying device, preferably in the region of the belt transfer. When the air separator is arranged downstream of the eddy current separating device in the conveying direction, the air separator can in particular be fed with the non-ferrous fraction—that is, the at least one third material fraction. The air separator can serve to separate light components, in particular plastic films or the like, which ultimately preferably have no metallic properties.

The air separator may also be configured to classify the flow supplied to the air separator. The air separator ultimately separates the conveying stream on the basis of the ratio of inertia and/or gravity to flow resistance in a gas and/or air stream. Accordingly, the air separator can "blow out" light components, in particular film-like components.

An arrangement of the air separator in the area of the belt transfer between the first conveying device and the further conveying device enables in particular an improved degree of separation. Light, preferably non-metallic, components can be removed from the conveying stream and thus also do not impair the further method—possibly by "wrapping" other conveyed material.

Furthermore, a third material discharge means can also be associated with the air separator, which can be designed as a chute, conveyor belt and/or container or the like and ultimately leads to the discharge of the separated material flow.

In this context, it is understood that at least one material discharge means (in particular chute, conveyor belt and/or container), preferably at least one material discharge means per material flow, can also be associated with the eddy current separating device for the material flows separated from one another.

In a further embodiment of the apparatus according to the invention, at least one, in particular height-adjustable, metering means may be provided. The metering means may be arranged on and/or in the metering hopper device. In particular, the metering means may be designed as a metering roller and/or metering pusher and/or as a pivotable flap.

The metering means formed as a pivotable flap may be provided on and/or as a side wall of the metering hopper device, as has been explained previously.

The metering roller can be arranged above the at least one metering opening of the metering hopper device and serve in particular for fractionation, equalization and/or preparation of the feed material. Furthermore, at least one metering roller may be arranged in a first metering hopper device, wherein the feed material may be applied to the metering roller and may be transferred to a further metering hopper device via the metering roller and/or the metering rollers.

A metering means designed as a pusher can be arranged in particular within the metering hopper device and preferably above the metering opening and serve for the preparation, equalization and/or levelling of the feed material.

Furthermore, in a further embodiment, a cage-like frame may be provided, which is provided at least in regions on the outside of the apparatus and in particular for arranging, fastening and/or supporting the individual, preferably modular, components of the apparatus. Accordingly, the individual components and parts of the apparatus may be arranged in particular within or on the cage-like frame. By means of the cage-like frame, the design as a mobile unit can be simplified, since in particular the individual components of the apparatus can be arranged in the frame and can be movable with the frame. The frame is designed to correspond to the height and/or length and/or width of the apparatus and ultimately serves as an outer "framing" and/or mount.

Furthermore, a bearing means of the frame may be provided for arranging the individual components of the apparatus. The bearing means may be arranged on the underside of the apparatus, facing the ground. Ultimately, the bearing means may be formed as a grid, a frame and/or, at least in some areas, a plate.

Furthermore, at least one axle, preferably two axles, and wheels attached to the axle, preferably at least two wheels per axle, may be provided on the frame. Via the wheels attached to the axle, a movable apparatus is made possible, which can be moved in particular by a towing vehicle.

Furthermore, at least one drawbar may be provided, which is preferably attached to the frame. The drawbar or even just a trailer coupling is particularly advantageous if the apparatus is designed as a trailer. When the apparatus is designed as a trailer, the apparatus can be connected to a towing vehicle via the drawbar or the trailer coupling and thus be designed in particular to be road-mobile.

Preferably, an adaptation to the place of use and/or to the respective country of the place of use with regard to approval guidelines for participation in road traffic is possible according to the invention.

Preferably, the apparatus is configured to process a capacity with respect to the separation of the feed material of between 10 to 100 t/h, preferably 25 to 75 t/h. In particular, at such a capacity, the feed material has a maximum length of up to 400 mm.

It is particularly preferred if the frame comprises at least one, preferably extendable, support. In particular, at least four supports are provided. The support may serve to provide support on the ground. The support on the ground provides in particular a safe, stationary use of the mobile apparatus for carrying out the method. Furthermore, the adjustable and extendable supports can be used to adapt to an uneven ground.

Alternatively or additionally, it is possible that the apparatus is formed in a modular manner into individual components of the apparatus that can be separated from each other. In particular, the individual module-like components of the apparatus may be arranged within the cage-like frame. A modular extension of an apparatus is also possible. Thus, a "basic equipment" of the apparatus may comprise the first magnetic separating device, the second magnetic separating device, the conveying device and the further conveying device. The aforementioned components can be extended in a modular manner, for example, by the metering hopper device, the eddy current separating device, at least one air separator and/or at least one material discharge means. Due to the modular structure of the apparatus according to the invention, the apparatus can in particular be adapted to individual customer requirements. Preferably, if the place of use is changed, the apparatus can be modularly extended and adapted to the respective purpose. In this context, the mobile design of the apparatus is again shown to be particularly advantageous.

Furthermore, in a particularly preferred embodiment of the invention, it is provided that the apparatus, preferably the conveying devices and/or conveyor belts, is designed in such a way that the cross-section and/or the width of the conveying stream and/or the passage cross-section of the material flow and/or the conveying stream in the conveying direction, increases and/or becomes wider. Preferably, an increase and/or a widening of at least 10% from the initial to the final passage cross-section is provided. Moreover, an increase and/or widening of the cross-section of at least 5% should be provided from one stage to the next, although such an increase and/or widening need not be provided at each stage.

Finally, it may be provided that the cross-section and/or the width of the conveying stream, in particular viewed transversely to the conveying direction, increases and/or widens in the conveying direction of the conveying stream from the beginning to the end. This refers to the region of the inlet of the conveying stream to the region of the outlet of the conveying stream from the apparatus. Of course, it can also be provided that the cross-section or the cross-sectional area of the conveying stream, in particular viewed transversely to the conveying direction, decreases, provided that the conveying speed is increased accordingly, in particular wherein the width can nevertheless become larger.

By the quasi-continuous and/or the stepwise widening and/or broadening of the material flow cross-section, in particular a levelling and equalization and furthermore an improved separation of the feed material is achieved. Finally, the individual belts transporting the conveying stream can be widened in the conveying direction.

Moreover, it is understood that any intermediate intervals and individual values are included in the aforementioned intervals and range limits and are to be considered disclosed as essential to the invention, even if these intermediate intervals and individual values are not specifically indicated.

Further features, advantages and possible applications of the present invention will be apparent from the following description of examples of embodiments with reference to the drawing and the drawing itself. In this connection, all the features described and/or illustrated constitute, individually or in any combination, the subject-matter of the present invention, irrespective of their summary in the claims and their relation back.

Figure 2:
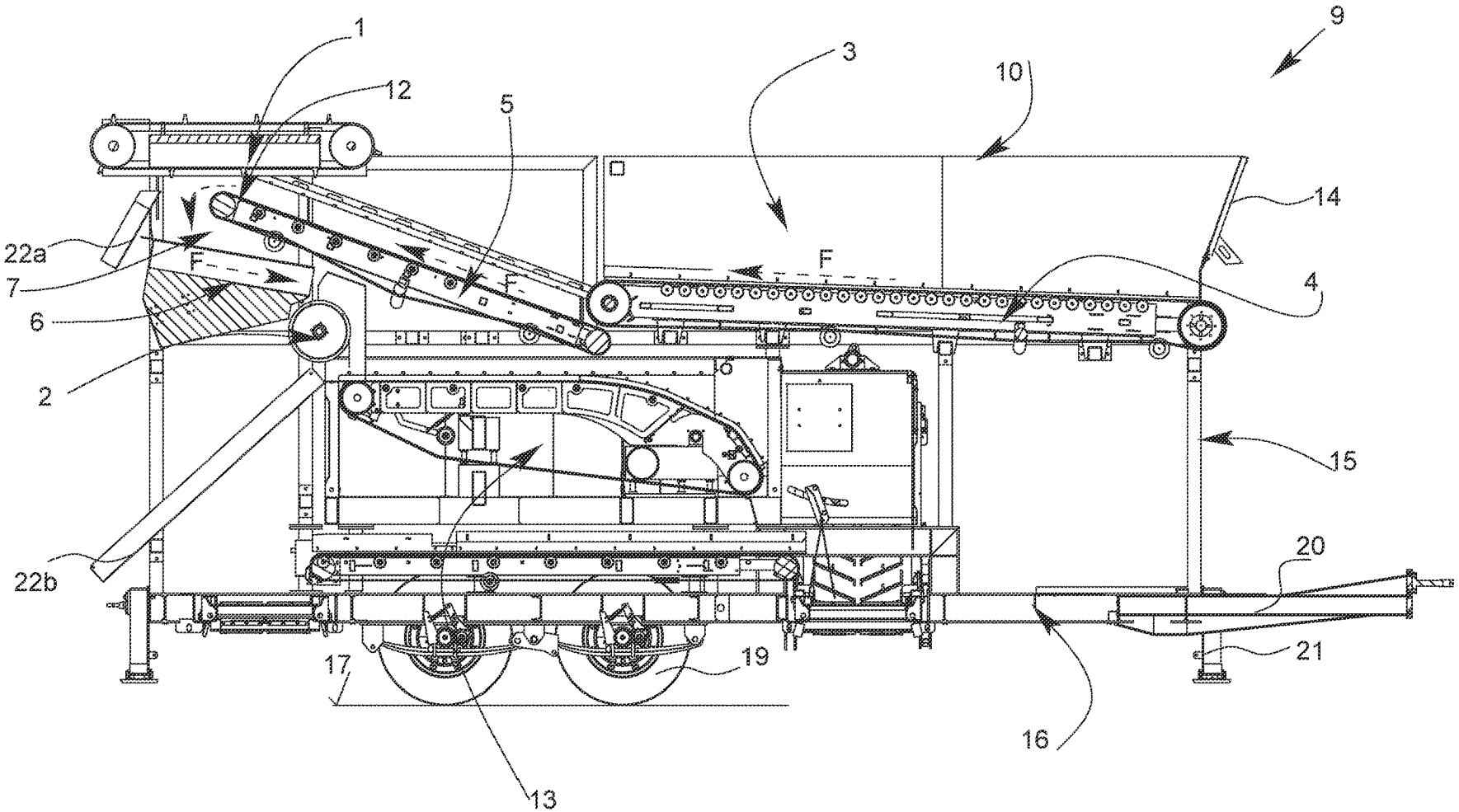
Figure 3:
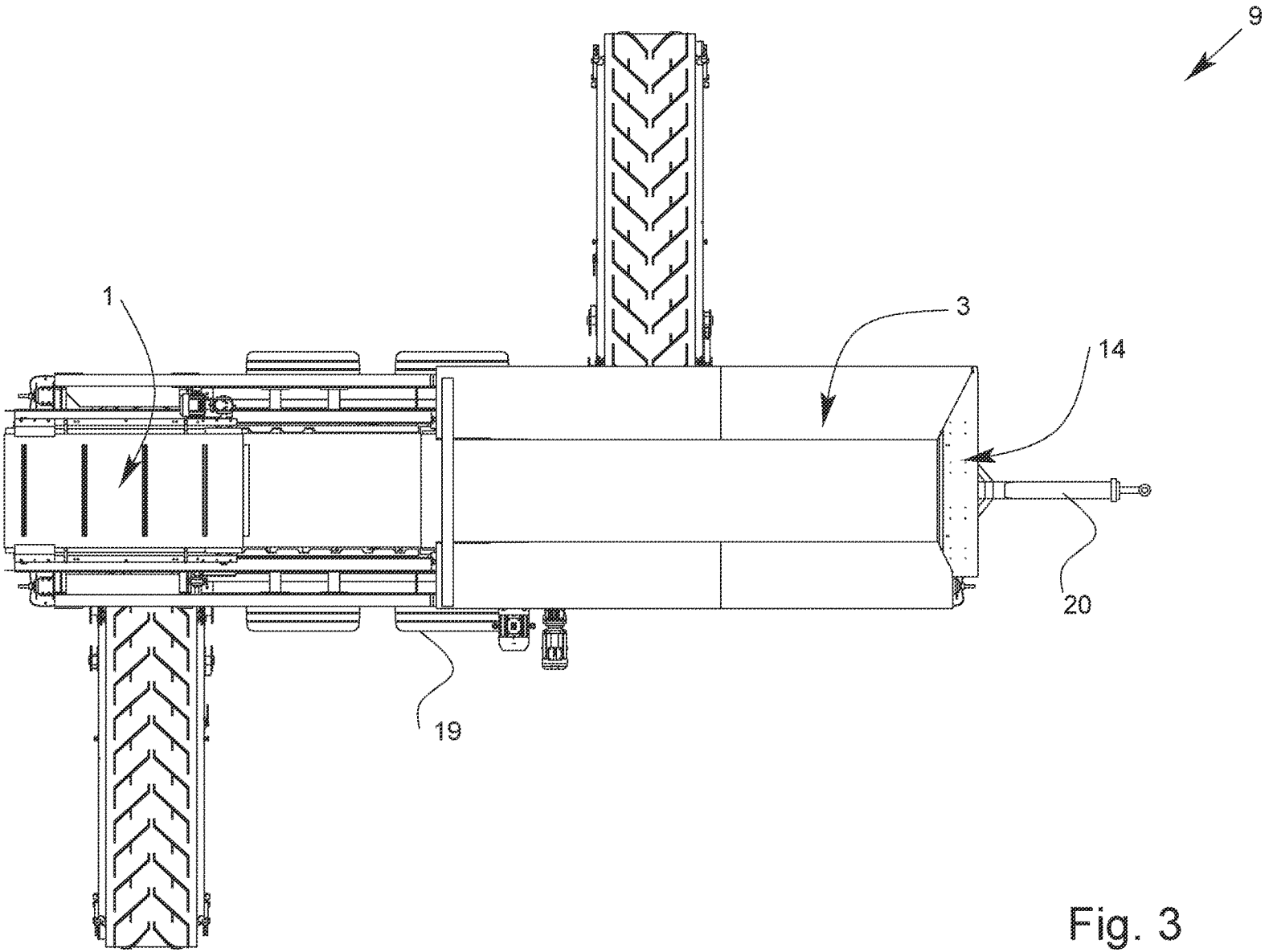
Figure 4:
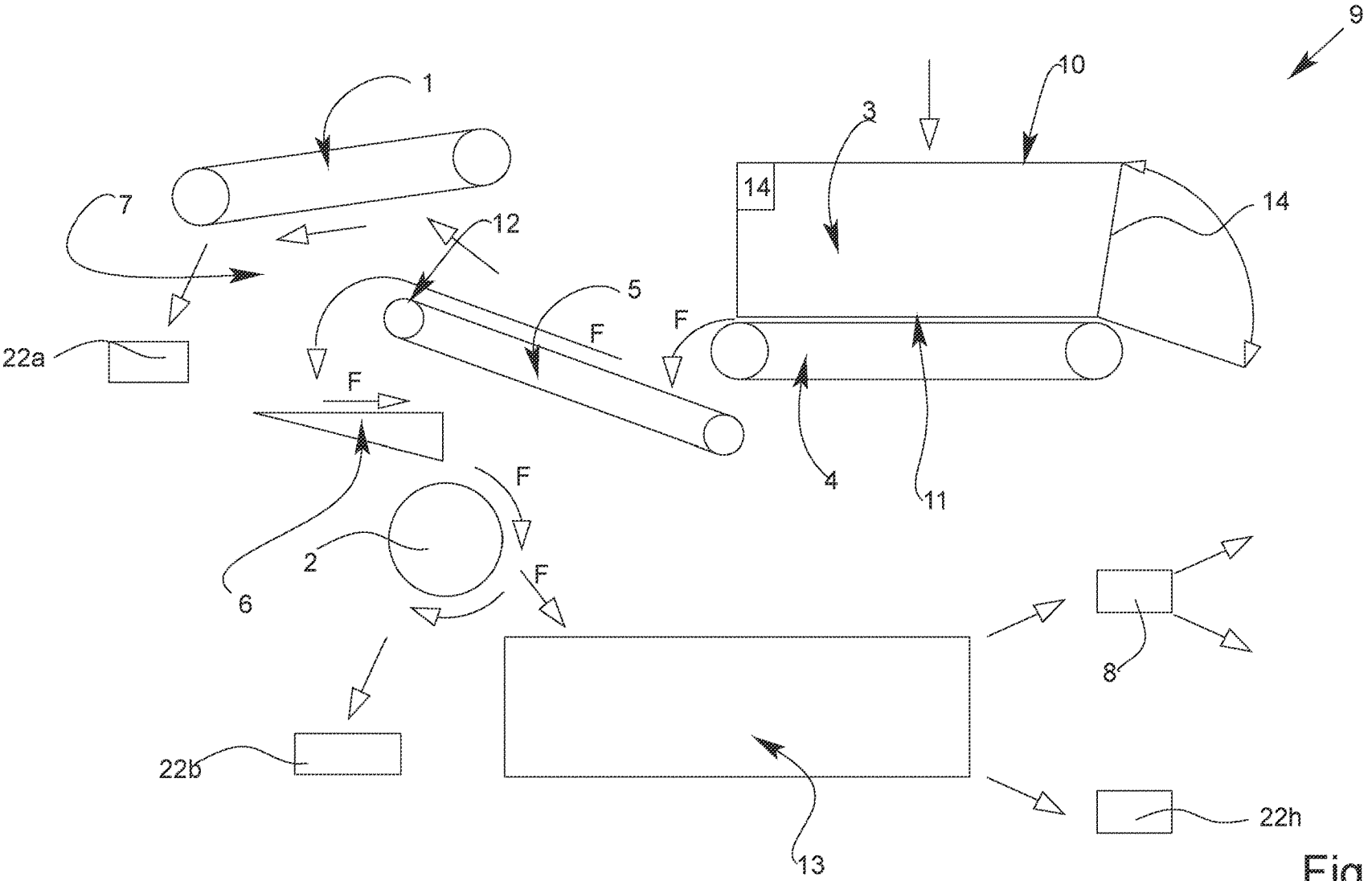
Figure 5:
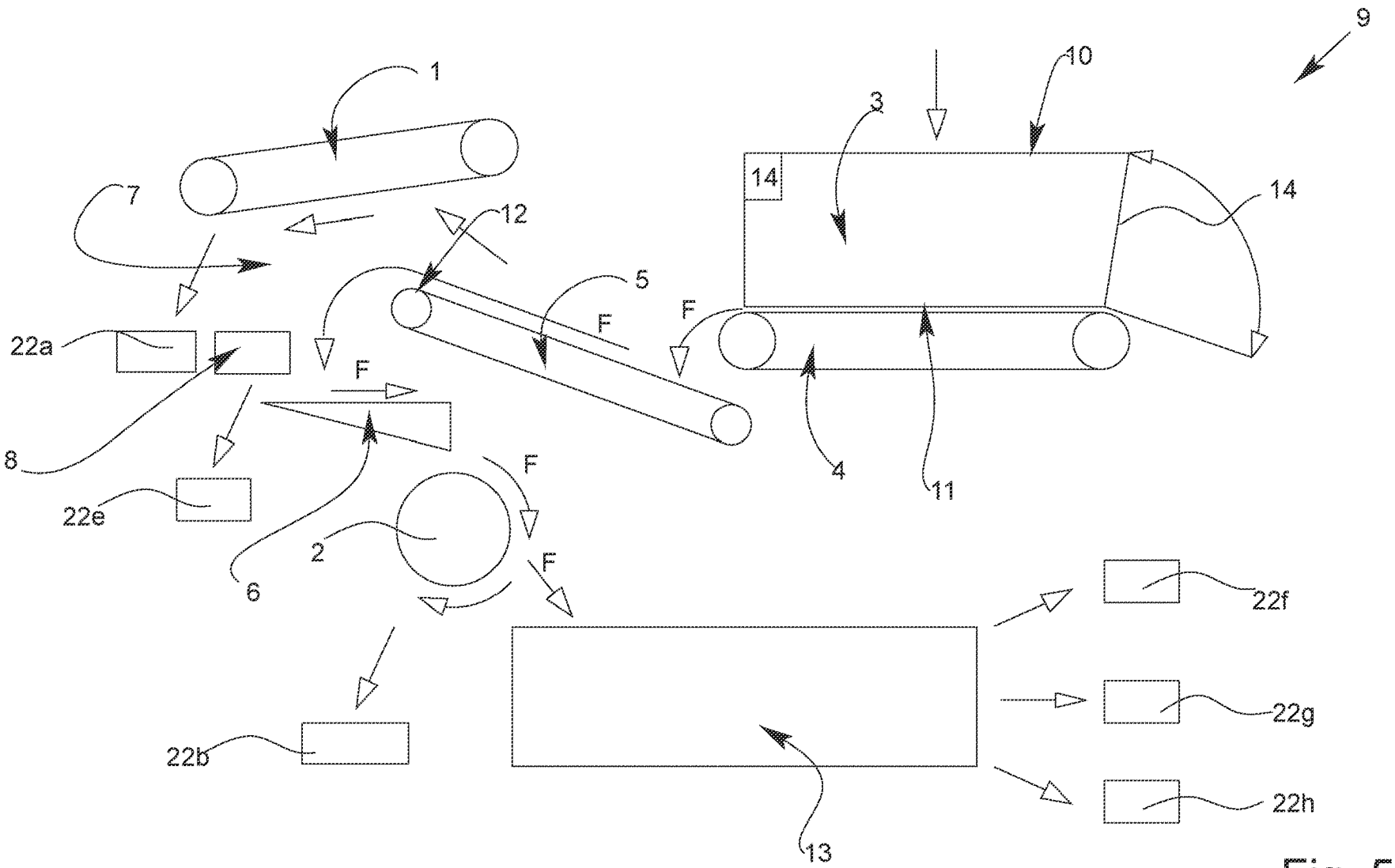
Figure 6:
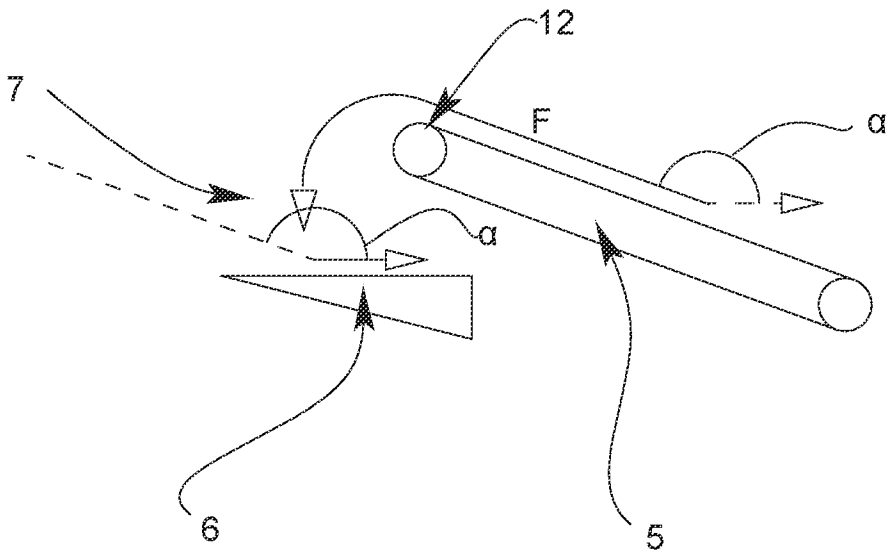
Figure 7:
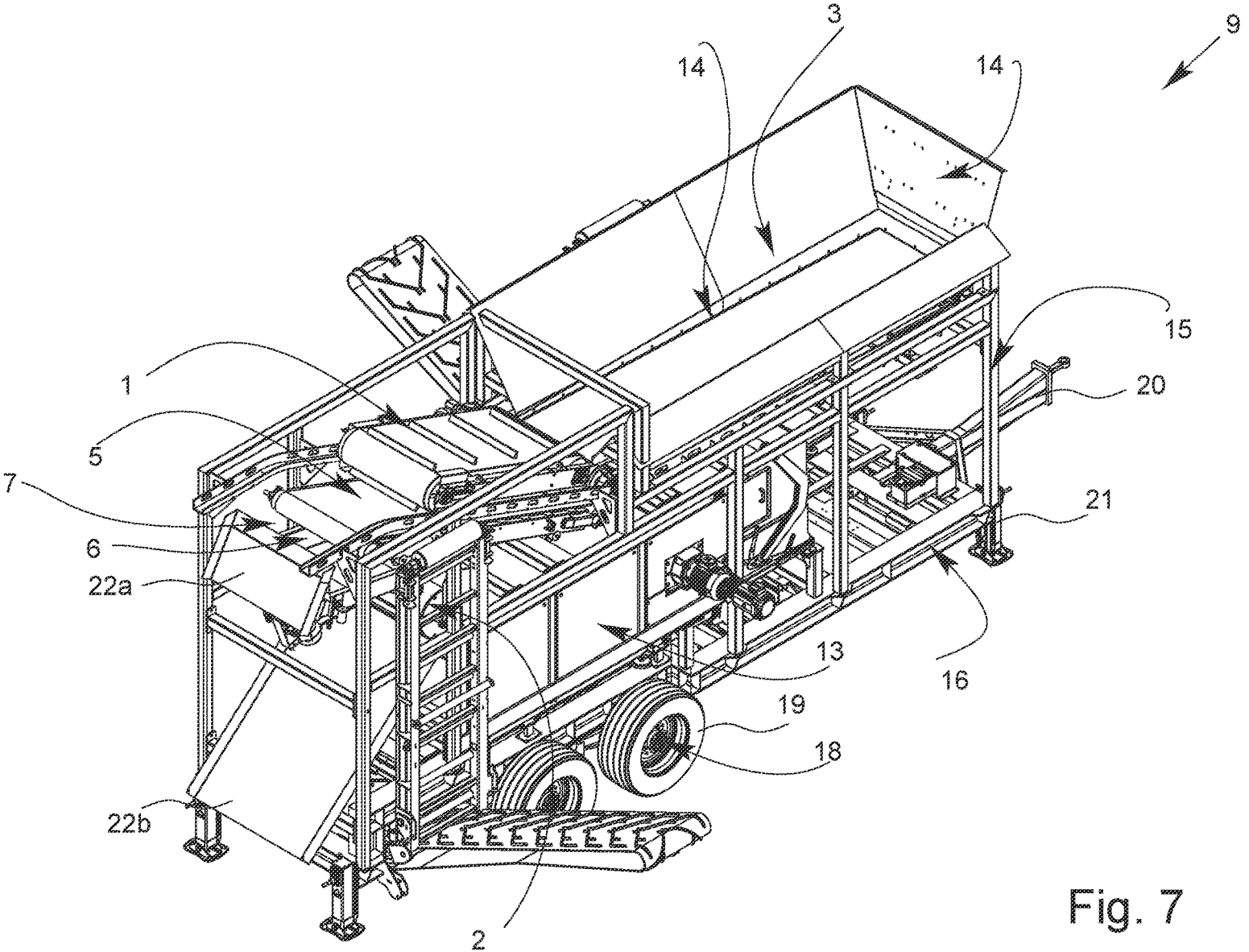
Figure 8:
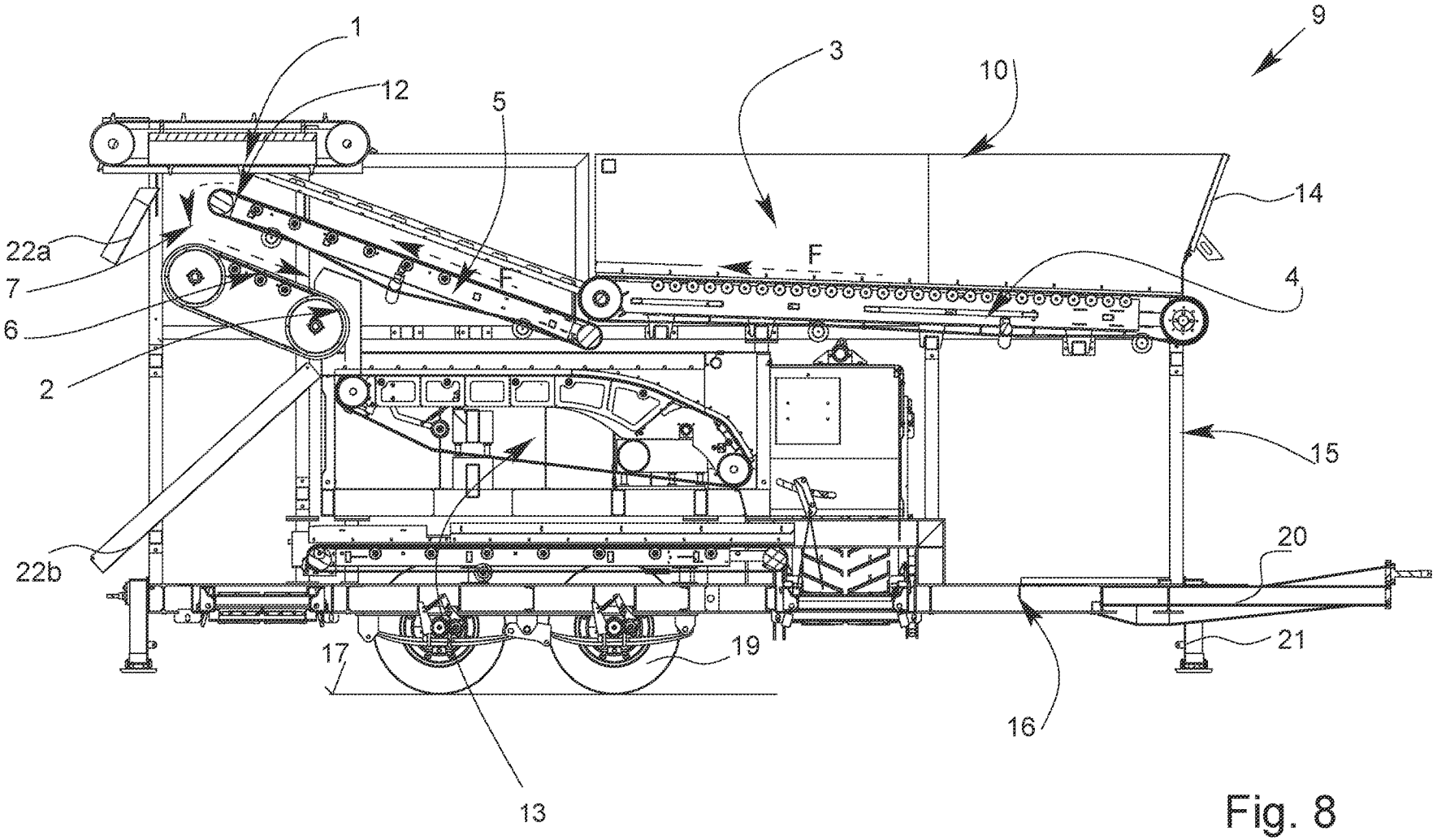
Figure 9:
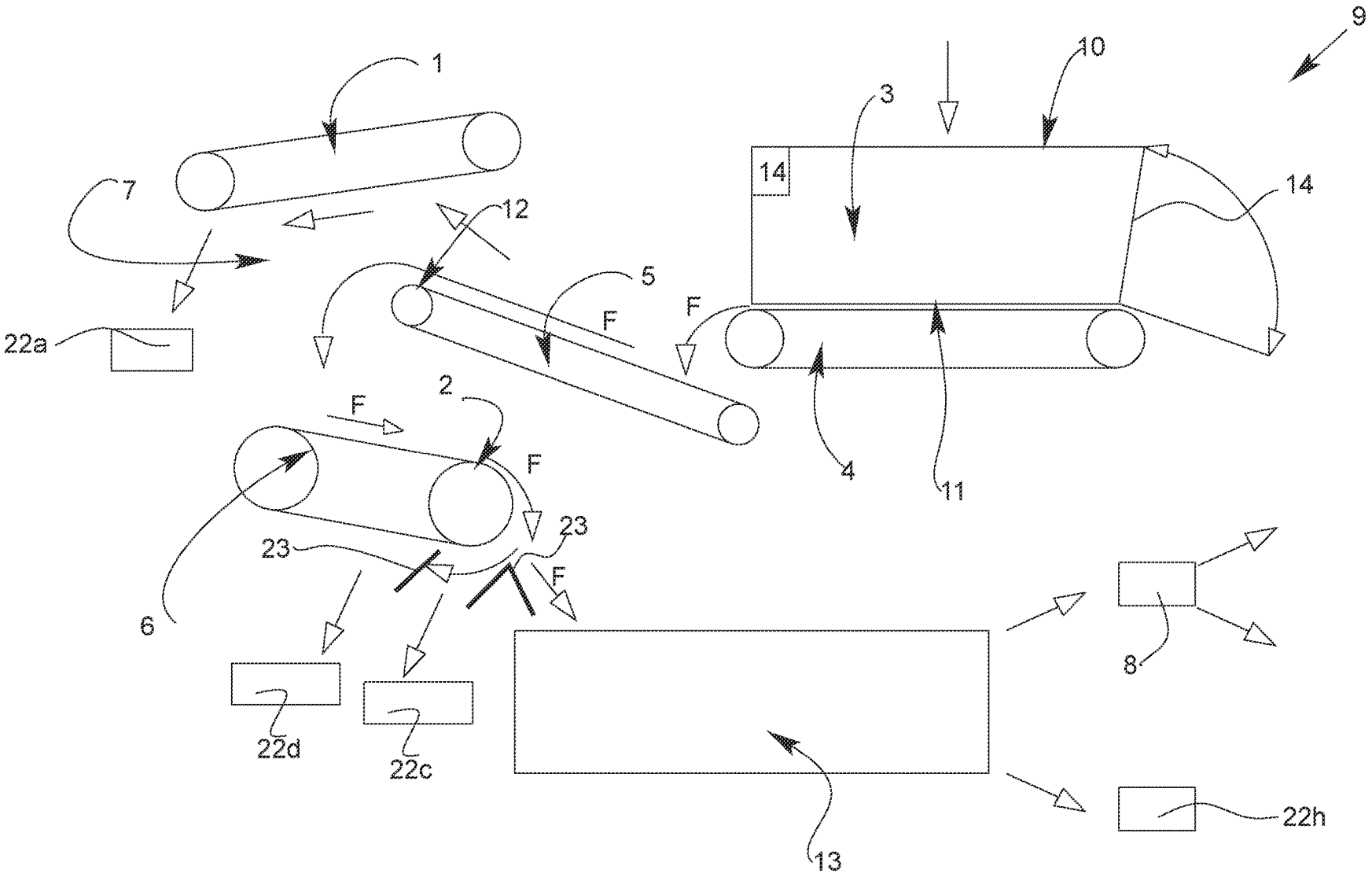
Figure 10:
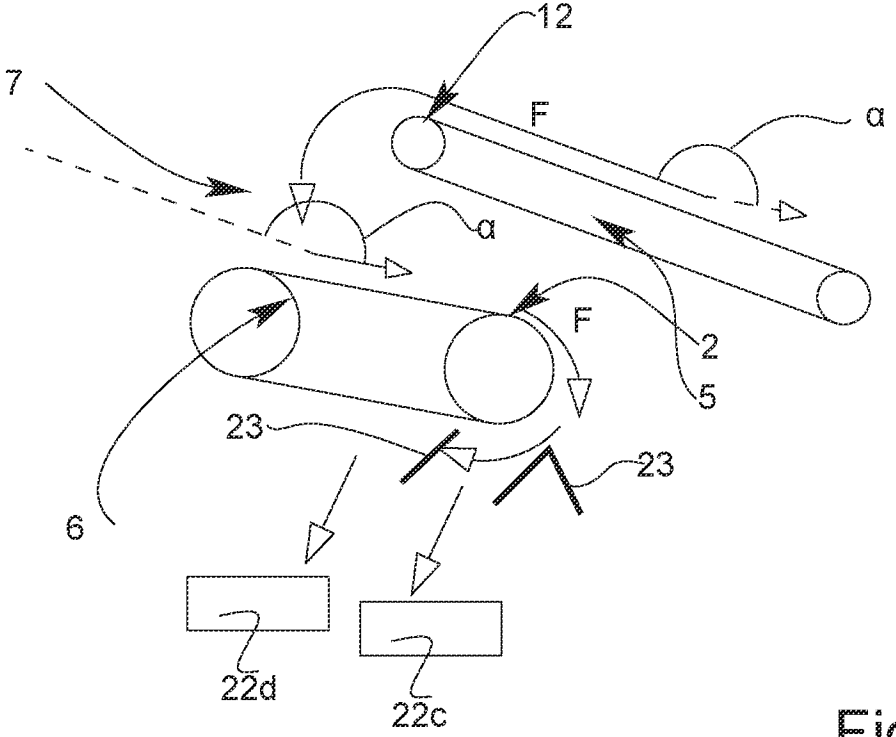

It shows:

FIG. 1 a schematic perspective view of an apparatus according to the invention, FIG. 2 is a schematic cross-sectional view of a further embodiment of the apparatus according to the invention, FIG. 3 a schematic top view of a further embodiment of the apparatus according to the invention, FIG. 4 is a schematic representation of a method according to the invention, FIG. 5 a schematic representation of a further embodiment of the method according to the invention, FIG. 6 a schematic representation of the belt transfer according to the invention, FIG. 7 a schematic perspective view of a further embodiment of the apparatus according to the invention, FIG. 8 a schematic cross-sectional view of a further embodiment of the apparatus according to the invention, FIG. 9 a schematic representation of a further embodiment of the method according to the invention and FIG. 10 a schematic representation of a further embodiment of the belt transfer according to the invention.

FIGS. 4 and 5 schematically show the sequence of a method for separating feed material. The feed material comprises at least one ferromagnetic material fraction and at least one non-ferrous material fraction (a non-ferrous metallic material fraction and/or a non-magnetic metallic material fraction). In this context, the ferromagnetic material fraction is to be understood such that this material fraction comprises and/or consists of ferromagnetic components. The non-ferrous material fraction may also comprise and/or consist of non-ferrous components and/or non-ferrous metal particles.

FIG. 5 further shows that a conveying stream is fed to a first separation of a ferromagnetic material fraction. In particular, the first separation is carried out by means of a first magnetic separating device 1. Subsequently, the conveying stream is supplied to a second separation of a second ferromagnetic material fraction. In particular, the second separation takes place by means of a second magnetic separating device 2, as can be seen in FIGS. 4 and 5.

According to the method, it is provided that a redistribution and/or reallocation of the material of the conveying stream takes place between the first separation and the second separation.

A reallocation and/or redistribution of the material is to be understood in such a way that ultimately the material of the conveying stream is mixed and fed to the second separation in a predominantly changed arrangement.

If, for example, there is still a layering in the conveying stream, the reallocation can be understood in such a way that at least one "lower" layer—with respect to the cross-section of the conveying stream, in particular viewed transversely to the conveying direction—can be arranged in the "upper" layer region after the first separation.

Ultimately, those lower components of the conveying stream which are arranged at least substantially on the lower side—facing a base 17—before the first separation may be arranged on the upper side in the cross-section, in particular viewed transversely to the conveying direction, of the conveying stream—facing away from the base 17—after the first separation and before the second separation. This can apply both to the redistribution and to the reallocation.

The base 17 may be understood as the area on which the apparatus 9 carrying out the method is arranged and/or parked.

A redistribution of the material of the conveying stream can be understood in such a way that—if, for example, no layer structure is present—a strong mixing and a reallocation and/or a "turning upside down" of the material of the conveying stream takes place between the first magnetic separating device 1 and the second magnetic separating device 2. In particular, ferromagnetic material particles and/or components can be fed to the second separation, which were not separable and/or separated with the first separation, ultimately because they were not or only poorly accessible.

Consequently, a reallocation and/or redistribution of the material of the conveying stream leads to an increase in the degree of separation of the ferromagnetic material fractions.

FIG. 5 shows that the feed material is fed into a metering hopper device 3. The dosing hopper device 3 can be designed as a bunker and ultimately serve to store and bunker the feed material.

The material to be conveyed can be transferred as a conveying stream from the metering hopper device 3 onto or to a metering device 4, in particular a belt feeder, preferably a hopper discharge belt. This is provided subsequent to the feeding of the feed material. The conveying stream is conveyed along the metering device 4.

FIGS. 4 and 5 show that the conveying stream is fed to the first separation—in particular to the first separating device 1—via a conveying device 5. The conveying device 5 can be designed as an accelerating belt. FIG. 4 shows that the conveying stream is transferred from the metering device 4 to the conveying device 5.

The conveying stream can be equalized along the conveying direction F of the conveying device 5. For this purpose, the speed of the conveying device 5 can be greater than the speed of the metering device 4. In particular, the speed is greater by at least 15%. An—at least partially provided—material separation can be achieved along the conveying device 5 in conveying direction F.

Furthermore, FIGS. 4 and 5 show that the conveying stream is fed to the second separation via a further conveying device 6. In the embodiment example shown in FIG. 2, the further conveying device 6 is designed as a vibrating chute which vibrates and/or oscillates to convey the conveying stream. In particular, the conveyed material is discharged from the further conveying device 6 onto the second magnetic separating device 2, as shown in FIG. 2.

FIG. 8 shows that the further conveying device 6 can also be designed as a conveyor belt.

In the embodiment example shown in FIG. 8, the second magnetic separating device 2 is arranged within or on the further conveying device 6. In the illustrated embodiment example, the second magnetic separating device 2 is designed as a magnetic deflecting roller of the further conveying device 6.

It is not shown that the first magnetic separating device 1 can also be arranged in or on the conveying device 5, in particular can be designed as a magnetic deflection roller in the area of the belt transfer 7.

FIG. 6 shows that the conveying direction F of the conveying device 5 runs at an angle $\alpha$ of greater than 90° to the conveying direction F of the further conveying device 6. In the illustrated embodiment example, the angle $\alpha$ is between 120° to 210°, in particular approximately 120°+/−20°. Due to the conveying directions F of the conveying device 5 and the further conveying device 6 extending at the angle $\alpha$ to each other, a redistribution and/or reallocation of the material can be achieved. Ultimately, the material flow to be conveyed can be subject to a reversal.

The further conveying device 6 is arranged below the conveying device 5 and projects over the discharge end of the conveying device 5 in the conveying direction F of the conveying device 5, so that the discharged material can be picked up by the further conveying device 6 without loss.

FIG. 2 shows that the conveying stream is discharged from the conveying device 5 onto the further conveying device 6. This can take place before the second separation and is ultimately provided in the area of the belt transfer 7 between the first conveying device 5 and the second conveying device 6.

The first separation can take place in the area of the belt transfer 7 of the conveying device 5 to the further conveying device 6. In particular, the first separation already takes place in the region of the belt end 12 of the conveying device 5, which faces away from the metering device 4.

FIG. 4 shows, as previously explained, that the conveying stream from the further conveying device 6 is dropped onto the second magnetic separating device 2, where the second separation takes place. By dropping the material onto the second magnetic separating device 2, a redistribution of the material can again be caused, which ultimately increases the degree of separation of the second separation.

FIG. 9 shows that the further conveying device 6 is designed as a conveyor belt, the second magnetic separating device 2 being designed as a deflecting roller and being arranged at the end, facing away from the belt transfer 7. Accordingly, the second separation can be made possible by the further conveying device 6 which is magnetic at the end.

FIG. 4 shows that a third separation of a non-magnetic and electrically conductive third material fraction (non-ferrous fraction) from the conveying stream takes place. In the illustrated embodiment, the third separation is provided after the second separation, wherein the third separation can be carried out by means of an eddy current separating device 13.

In addition, FIG. 4 shows that a fourth separation of a fourth fraction of material is carried out by means of an air separator 8. According to the embodiment example shown in FIG. 4, the fourth separation is performed after the third separation. In particular, the fourth separation may be carried out with the separated third material fraction which is non-magnetic and electrically conductive, comprising in particular the non-ferrous material fraction. Alternatively or additionally, the fourth separation may be carried out with the conveying stream separated from the third material fraction and/or with the residual fraction.

FIG. 5 shows that the air separator 8 can also be arranged in the area of the belt transfer 7. The fourth separation may take place after and/or before and/or during the first separation.

In the embodiment example shown in FIG. 5, no further air separator 8 is provided downstream of the third separation. However, this may be provided in further embodiments not shown.

In the embodiment example shown in FIG. 5, the third separation is designed in such a way that at least two non-magnetic and electrically conductive third material fractions can be separated. In this respect, the eddy current separating device 13 can be designed in such a way that the non-ferrous metals to be separated can be separated from one another, in particular according to their material. For example, separate separation of aluminium, bronze, brass and/or copper can be performed.

In the method, it can be provided in principle that the conveying stream is again fed to the metering hopper device 3 as feed material after the third separation and/or the fourth separation. In this way, the conveying stream can pass through the method several times, in particular at least twice. For effective separation of the ferromagnetic material fractions, however, a single pass through the method is sufficient.

Before the feed material is fed in, it may have been previously comminuted and/or separated. In particular, the material stream to be processed is to be treated in such a way that the material fractions to be separated can also be separated via individual components that can be separated from each other. Preferably, a multiple method run may also be performed for the separated third substance fraction and/or the separated third substance fractions. The non-ferrous material fractions may be fed again, so that the selective throw-off behavior of the eddy current separating device 13 is utilized and/or an extraordinary separation efficiency for the non-ferrous metals is achieved. This can be done within a post-cleaning method with a significantly reduced fraction, preferably automatically by dosing from the metering hopper device 3. For example, this can be done within a night shift. During a day shift—in which the apparatus 9 is used—the primary volume of process material or feed material can be processed—which represents the usual method sequence.

The separated material fractions and/or the residual fraction can be separated and/or collected via material discharge means 22*a*-22*h*. Material discharge means 22*a*-22*h* may be conveyor belts, chutes and/or containers or the like. Ultimately, this serves to discharge the separated material fractions.

The material discharge means 22*a* shows a means for material discharge for the first material fraction, the material discharge means 22*b* shows a means for material discharge for the second material fraction, whereas the material discharge means 22*f*-22*h* each show a means for material discharge after the third separation.

As can be seen from FIG. 9, the second material fraction can be divided and/or separated into at least two material fractions—on the basis of their magnetic properties. Separating means 23, which may be formed as a separating plate and/or as a separating apex plate, may be used for this purpose, for example.

FIG. 9 shows that at least two separating means 23 are provided for the second material fraction. The second material fraction may be supplied to the material discharge means 22*c* and 22*d* via separating means 23. For example, the material discharge means 22*c* can be used to separate a stainless steel fraction of the second material fraction which has lower ferromagnetic properties than the ferrous fraction of the second material fraction which can be discharged via the material discharge means 22*d*.

It is not shown that separating means 23 for "sub-fractionation" may also be provided for the first material fraction, which may perform separation on the basis of magnetic properties. In this context, it is understood that a plurality of material discharge means 22 may also be provided for the first material fraction.

FIG. 10 shows that one separating means 23 may be formed as an angled apex sheet and another separating means 23 may be formed as a straight, non-angled sheet.

Not shown is that only one separating agent 23 can be used to sub-fractionate the second ferromagnetic material fraction.

It is not shown that an extension and/or widening of the passage cross-section of the conveying stream in conveying direction F is provided. Preferably, the conveying means transporting the conveying stream, in particular the conveying means 5, the further conveying means 6 and/or eddy current separating means 13, become wider along or in the conveying direction F. This can be done by a gradual widening of the conveyor belts. Preferably, the width of the conveyor belts increases in total by at least 15%.

FIG. 1 shows an apparatus 9 for carrying out the method according to one of the embodiments described above. The apparatus 9 is provided for separating feed material. The feed material comprises at least one ferromagnetic material fraction and at least one non-ferrous material fraction. The apparatus 9 comprises a first magnetic separating device 1 for first separation of a first ferromagnetic material fraction. Furthermore, the apparatus 9 comprises a second magnetic separating device 2 for second separation of a second ferromagnetic material fraction. A conveying device 5 is provided for supplying the conveying stream to the first magnetic separating device 1. A further conveying device 6 is in turn provided for supplying the conveying stream to the second magnetic separating device 2, wherein the conveying device 5 and the further conveying device 6 are arranged in such a way that a redistribution and/or reallocation of the material of the conveying stream takes place between the first magnetic separating device 1 and the second magnetic separating device 2.

FIG. 6 shows that the conveying direction F of the conveying device 5 runs at an angle $\alpha$ of greater than 90° to the conveying direction F of the further conveying device 6. In the illustrated embodiment example, the angle $\alpha$ is approximately 120°+/−20°.

The redistribution and/or reallocation of the material of the conveying stream has been explained at the beginning, and reference may be made to these explanations in this context.

The apparatus 9 is ultimately designed in such a way that a double ferromagnetic separation can take place, wherein in addition the, in particular metallic, non-ferrous material fraction can be separated from the conveying stream. In particular, the metallic fractions of the feed material can be separated.

The apparatus 9 shown in FIG. 1 is designed as a mobile unit. The mobile unit can be transported, in particular moved, for example along roads. Consequently, the apparatus 9 can be used at different locations. A towing vehicle can be provided for moving the apparatus 9.

Due to the redistribution and/or reallocation of the material and thus due to the particular arrangement of the conveying device 5 and the further conveying device 6, a compact longitudinal design of the apparatus 9 can be made possible, which ultimately also ensures its design as a mobile unit. The individual components can be arranged in areas one above the other or one below the other, so that the available space can be utilized at least substantially in the best possible way.

By means of the second magnetic separating device 2, in particular small parts of the conveying stream which have not been separable by the first magnetic separating device 1 can be separated. This second separation can, for example, take place with a contacting surface to which the second ferromagnetic material fraction can adhere.

FIG. 3 shows a top view of the apparatus 9. Furthermore, FIG. 3 shows that a metering hopper device 3 is provided. In the illustrated embodiment example, the metering hopper device 3 is arranged at the top of the apparatus 9, facing away from a base 17.

The metering hopper device 3 is used for feeding the feed material and ultimately also for storing and metered addition of the feed material as a conveying stream to the units carrying out the method.

The metering hopper device 3 has a feed opening 10 for feeding the feed material. A metering opening 11 of the metering hopper device 3 is provided on the underside of the metering hopper device 3, facing the base 17, as can be seen in FIG. 5.

It is not shown that the metering opening 11 can also be adjusted, in particular closed and/or opened. Ultimately, the metering hopper device 3 may be formed as an at least substantially truncated pyramid-shaped and/or cuboid-shaped receptacle. Ultimately, the dosing hopper device 3 may have at least substantially oblique side walls tapering towards the metering opening 11.

The feed of the material onto the metering hopper device 3 can take place in longitudinal direction—that is in longitudinal extension of the apparatus 9. In this way, the material can be given a longitudinal orientation in the direction of material flow. A conveyor belt can also be arranged on the metering hopper device 3, which feeds the feed material to the metering hopper device 3.

Furthermore, at least one, in particular height-adjustable, metering means 14 can be provided. The metering means 14 can be arranged on and/or in the metering hopper device 3—as shown schematically in FIG. 4. In particular, the metering means 14 may be formed as one or more dosing rollers and/or as a slider. The metering rollers can be arranged within the metering hopper device 3 on the upper side—facing away from the base 17—of the metering opening 11. The feed material can first be guided over the metering rollers before being fed to the conveying device 5, so that in particular a separation and/or loosening of the feed material takes place.

The slider can serve to equalize the feed material in the metering hopper device 3. The metering hopper device 3 can ultimately also be of two-part design, in particular if metering rollers are provided in the metering hopper device 3, wherein the metering rollers can be arranged in an upper part of the metering hopper device 3.

In FIG. 1 it is shown that a metering means 14 designed as a pivotable flap is provided, wherein the feed material of the metering hopper device 3 can be transferred in the longitudinal direction of the apparatus 9 via the pivotable flap. The flap thus represents the rear short side of the feed hopper and/or of the metering hopper device 3.

FIG. 2 shows that a metering device 4 for conveying the conveying stream is provided at least in regions below the metering hopper device 3, in particular below the metering opening 11 and/or facing away from the feed opening 10. In the embodiment example shown, the metering device 4 is designed as a belt feeder, in particular as a hopper discharge belt. By feeding onto the metering device 4, the feed material is fed as a conveying stream to the first magnetic separating device 1.

In the embodiment example shown in FIG. 2, the conveying device 5 is arranged in such a way that the conveying stream can be transferred from the metering device 4 to the conveying device 5. Upon transfer from the metering device 4 to the conveying device 5, the conveying stream can be discharged onto the conveying device 5. As shown in the illustrated embodiment example, the conveying device 5 is designed as a transport and acceleration belt.

The speed of the conveying device 5 may be greater, in particular at least 15% greater and/or between 100% and 500% greater, than the speed of the metering device 4. Along the conveying device 5, the conveying stream is equalized in conveying direction F, wherein the material of the conveying stream is at least substantially separated.

FIG. 1 shows that the first magnetic separating device 1 is designed as an overband magnetic separator. The first magnetic separating device 1 is arranged above the conveying device 5. FIG. 2 shows that the first magnetic separating device 1 is arranged in the region of the belt transfer 7 between the conveying device 5 and the further conveying device 6 and in the region of the belt end 12 of the conveying device 5 facing away from the metering device 4. The arrangement of the first magnetic separating device 1 is thereby provided in such a way that along the conveying direction F of the conveying device 5 the first ferromagnetic material fraction can be separated from the conveying stream.

After separation of the first ferromagnetic material fraction via the first magnetic separating device 1, the first ferromagnetic material fraction can be fed to a material discharge means 22*a*, in the illustrated embodiment example according to FIG. 1 a chute.

It is not shown that a container and/or a conveyor belt may also be provided as the material discharge means 22*a* of the first magnetic separating device 1.

The first magnetic separating device 1 is designed in such a way that the first ferromagnetic material fraction adhering to it can be separated via the material discharge means 22, wherein the magnetic connection between the first ferromagnetic material fraction and the magnetic separating device 1 designed as an overband magnetic separator can be released—for example by a separator.

It can be seen from FIG. 2 that the first conveying device 5 is inclined upwards with respect to the base 17 on which the apparatus 9 is arranged.

The metering means 4 may extend at least substantially parallel to the base 17, and the metering means 4 may include an angle of at most 15°+/−5° with respect to the base 17.

The conveying device 5 can enclose an angle of 45°+/−20° with respect to the metering device 4 and/or the base 17 and ultimately convey the conveying stream upwards—that is, away from the base 17—whereby the compact design and the road-mobile design of the apparatus 9 can be made possible.

The first magnetic separating device 1 designed as an overband magnetic separator and/or the further conveying device 6 may be arranged at least substantially parallel to the metering device 4 and/or the base 17, in particular with an angular deviation of +/−10°.

FIG. 2 shows that the further conveying device 6 is arranged in such a way that the conveying stream can be transferred from the conveying device 5 to the further conveying device 6. In the method sequence shown in FIG. 4, it is provided that the conveying stream is discharged from the conveying device 5 onto the further conveying device 6.

Furthermore, FIG. 2 shows that the further conveying device 6 is arranged, at least in some regions, below the conveying device 5, facing away from the first magnetic separating device 1.

The further conveying device 6 may be designed as a vibrating chute, which transports the material to be conveyed as a conveying stream to the second magnetic separating device 2 by means of vibrations and/or oscillations.

FIG. 8 shows that the further conveying device 6 can be designed as a transport and/or conveyor belt.

It is further apparent from FIGS. 8 and 9 that the second magnetic separating device 2 may be arranged on and/or in the further conveying device 6, which is in the form of a conveyor belt. In the illustrated embodiment example, the second magnetic separating device 2 is designed as a magnetic deflecting roller. Accordingly, the conveying stream from the further conveying device 6 is not discharged onto the second magnetic separating device 2, but the second separation takes place along the conveying direction F of the further conveying device 6. By means of the second magnetic separating device 2, which is designed as a deflecting roller, a further sub-fractionation of the second ferromagnetic material fraction can take place, in particular wherein stainless steel particles can be separated via the material discharge means 22*d*.

It is not shown that the first magnetic separating device 1 may also be designed as a magnetic deflection roller, which may be arranged on and/or in the conveying device 5.

Moreover, FIG. 2 shows that the second magnetic separating device 2 is arranged at least in some regions below the further conveying device 6, facing away from the first magnetic separating device 1. The conveying stream can be discharged from the further conveying device 6 onto the second magnetic separating device 2. In the illustrated embodiment example, the second magnetic separating device 2 is formed as a rotatable magnetic drum. The rotatable magnetic drum may ultimately have a contactive surface, so that it may be formed as a magnetic separator roller. Small parts in particular, which could not be separated with the first magnetic separating device 1 designed as an overband magnetic separator, adhere to the contactive surface of the magnetic drum.

Accordingly, the second ferromagnetic material fraction 2 adheres to the contactive surface of the second magnetic separating device 2, which can be transferred to a material discharge means 22. The transfer to the material discharge means 22, which is in the form of a chute, is shown in FIG. 2.

Not shown is that the material discharge means 22 may also be in the form of a conveyor belt and/or container.

The second magnetic separating device 2 is designed in such a way that the second ferromagnetic material fraction can be transferred to the material discharge means 22. The conveying stream freed from the second ferromagnetic material fraction can be transported further in conveying direction F, as can be seen from FIG. 4.

Consequently, before the third separation, the ferrous parts and/or the stainless steel components of the conveying stream can be separated, in particular divided.

FIG. 1 shows that an eddy current separating device 13 is provided for separating at least one non-magnetic and electrically conductive third material fraction. The third material fraction may comprise and/or include the non-ferrous material fraction. As the non-ferrous material fraction, non-magnetic metals may be extracted from the conveying stream. The non-ferrous metals (NF metals) are primarily light metals and/or copper, brass and/or bronze particles and/or stainless steel and/or aluminum.

In the embodiment example shown in FIG. 5, the eddy current separating device 13 is designed such that two different non-ferrous material fractions or two different third material fractions can be separated. These material fractions may differ with respect to their material. For example, particles and/or components of the conveying stream comprising copper, aluminum, brass and/or bronze and/or stainless steel can be separated separately. Also, the third material fraction may be discharged via at least one material discharge means 22 (shown: 22*f* and 22*g*), which may be in the form of a chute, conveyor belt and/or container.

The eddy current separating device 13 can be designed in such a way that the non-ferrous metal fraction (third material fraction) is separated by induced magnetic fields. The eddy current separating device 13 may also be referred to as a non-ferrous separator. The eddy current separating device 13 may comprise a magnet system, in particular a rotor, which is made of and/or comprises permanent magnet material, in particular neodymium. Longitudinal grooves may be arranged on the circumference of the rotor with alternating magnetic poles. The rotor can rotate as a pole wheel, over which the conveyor belt with the bulk material and/or the conveying stream runs. The conveying stream is subjected to an alternating magnetic field in the eddy current separating device 13, whereby eddy currents perpendicular to the alternating magnetic flux are generated within the particles. These eddy currents in turn set up magnetic fields opposing the induced fields. This results in a repulsive force effect. The conductive particles are thrown off and collected in the conveying direction F of the conveyor belt by the magnetic force effect. The non-conductive residual fraction (the remaining conveying stream) falls down at the end of the conveyor belt in a discharge parabola unaffected by the magnetic field and/or is discharged via a material discharge means 22*h*.

FIG. 2 shows that the eddy current separating device 13 can be arranged at least substantially below the further conveying device 6 and in particular below the second magnetic separating device 2—facing the base 17. This further supports the compact design of the apparatus 9. Furthermore, the eddy current separating device 13 may also be arranged below the conveying device 5 and, at least in regions, below the metering device 4.

FIGS. 4 and 5 show that an air separator 8 is provided for separating a fourth material fraction. The air separator 8 can be arranged in such a way that the conveying stream and/or the third material fraction can be transferred from the eddy current separating device 13 to the air separator 8, as can be seen in FIG. 4. Downstream of the air separator 8, a material discharge means 22 (in FIG. 5 22*e*) can be arranged, which serves to collect the fourth material fraction separated by the air separator 8.

The air separator 8 can be designed in such a way that in particular light, preferably non-metallic particles can be separated—such as plastic films or the like. The air separator 8 may lead to the separation of a fourth material fraction by a wind flow directed towards the conveying stream, which may be blown out of the conveying stream on the basis of its inertial and/or gravitational properties.

In the embodiment example shown in FIG. 5, it is provided that the air separator 8 is arranged between the conveying device 5 and the further conveying device 6—namely in the region of the belt transfer 7. Accordingly, in the region of the belt transfer 7, both the first separation of the first ferromagnetic material fraction and the fourth separation of the fourth material fraction can take place.

It is not shown that at least two air separators 8 may also be provided, wherein one air separator 8 may be arranged downstream of the eddy current separating device 13, in particular for separating the fourth stock fraction from the third stock fraction. Moreover, a further air separator 8 may also be arranged in the region of the belt transfer 7.

In FIG. 1 it is shown that a cage-like frame 15 is provided. The cage-like frame 15 may be provided in regions on the outside of the apparatus 9 and serve in particular for arranging, fastening and/or supporting the individual, preferably modular, components of the apparatus 9. The cage-like frame 15 may be constructed at least in some areas by struts—that is, by longitudinal and/or transverse struts.

FIG. 7 shows that the first magnetic separating device 1 is displaceably mounted along rails arranged on the frame 15. In FIG. 7, the first magnetic separating device 1 is displaced obliquely downwards in comparison with the arrangement shown in FIG. 1, in particular parallel to the longitudinal extent of the conveying device 5, in such a way that it faces the belt end of the conveying device facing the metering device 4 and/or is arranged in regions above this belt end. In particular, the position of the first magnetic separating device 1 shown in FIG. 7 is provided for moving the apparatus 9. In particular, the first magnetic separating device is hydraulically lowered by a chain.

A bearing means 16 of the frame 15 may be provided for supporting the apparatus 9, as can be seen from FIG. 1. In particular, the bearing means 16 is arranged on the underside of the apparatus 9, facing the base 17. The bearing means 16 may be formed as a grid and/or, at least in some areas, as a bearing plate, and ultimately constitutes the base of the frame 15.

Furthermore, at least one axle 18, preferably two axles 18, may be provided on the bearing means 16 or on the frame 15. At least two wheels 19 may be arranged on one axle 18.

FIG. 1 shows that a drawbar 20 can also be provided on the bearing means 16. For support on the base 17, supports 21 and/or a support 21 may be provided, which are in particular extendable.

The apparatus 9 shown in FIG. 1 is designed as a trailer. Furthermore, the apparatus 9 as a whole with its individual components has a modular structure. Thus, the individual devices of the apparatus 9 can be added and/or removed—depending on the intended use. However, the apparatus 9 comprises at least the first magnetic separating device 1, the second magnetic separating device 2 as well as the conveying device 5 and the further conveying device 6.

Furthermore, the apparatus 9 may be configured in such a way that in a further—not shown—embodiment example the cross-section and/or the width of the conveying stream increases and/or widens in conveying direction F. Preferably, the cross-section and/or the width may increase by at least 10% from the beginning to the end. For this purpose, the conveying devices 5, 6 and/or the conveyor belts of the apparatus 9 can be designed accordingly, so that ultimately the passage cross-section of the material flow along the method path can be made wider.

REFERENCE LIST

1 First magnetic separating device
2 Second magnetic separating device
3 Metering hopper device
4 Metering device
5 Conveying device
6 Further conveying device
7 Belt transfer
8 Air separator
9 Apparatus
10 Feed opening
11 Metering opening
12 Belt end
13 Eddy current separating device
14 Metering means
15 Frame
16 Bearing means
17 Base
18 Axle
19 Wheels
20 Drawbar
21 Support
22*a-h* Material discharge means
23 Separating means
F Conveying direction
α Angle

The invention claimed is:

1. A method for separating feed material, wherein the feed material comprises at least one ferromagnetic material fraction and one non-ferrous material fraction, the method comprising:

feeding, by a first magnetic separating device, a conveying stream to a first separation of a first ferromagnetic material fraction, and feeding, by a second magnetic separating device, the conveying stream to a second separation of a second ferromagnetic material fraction from the conveying stream, wherein a redistribution and/or reallocation of the material of the conveying stream takes place between the first separation and the second separation, and wherein the second magnetic separating device is at least in part arranged below a further conveying device, facing away from the first magnetic separating device, and the second magnetic separating device is a rotatable magnetic drum, and separating, by an eddy current separating device and after the second separation, at least one non-magnetic and electrically conductive third material fraction from the conveying stream, the eddy current separating device being arranged in such a way that conveying current from the second magnetic separating device can be transferred or discharged to the eddy current separating device and the eddy current separating device has portions located below the second magnetic separating device, facing away from the first magnetic separating device.

2. The method according to claim 1, wherein the feed material is fed into a metering hopper device.

3. The method according to claim 1, wherein the material to be conveyed is transferred as a conveying stream from the metering hopper device to a metering device, a belt feeder, or a hopper discharge belt, the conveying stream being conveyed along the metering device, the belt feeder or the hopper discharge belt.

4. The method according to claim 1, wherein the conveying stream is fed to the first separation via a conveying device, or an accelerating belt, wherein one or more of:

the conveying stream is transferred from the metering device to the conveying device, the conveying stream is equalized in the conveying direction after transfer from the metering device to the conveying device, and the speed of the conveying device is greater, preferably by at least 15% greater, than the speed of the metering device.

5. The method according to claim 1, wherein the conveying stream is fed to the second separation via the further conveying device, or a vibrating chute, wherein the further conveying device vibrates and/or oscillates.

6. The method according to claim 1, wherein the conveying direction of the conveying device runs at an angle α of greater than 90° to the conveying direction of the further conveying device.

7. The method according to claim 1, wherein the conveying stream is discharged from the conveying device onto the further conveying device.

8. The method according to claim 1, wherein the first separation takes place in the region of the belt transfer of the conveying device to the further conveying device.

9. The method according to claim 1, wherein the conveying stream is discharged from the further conveying device onto the second magnetic separating device and/or that the second separation takes place while the conveying stream is conveyed along the further conveying device.

10. The method according to claim 1, wherein a fourth separation of a fourth material fraction takes place by an air separator, or wherein the fourth separation takes place after the first separation and before the second separation when the conveying stream is discharged onto the further conveying device, and/or after the third separation.

11. An apparatus configured to separate feed material, comprising:

a first magnetic separating device adapted to separate a first ferromagnetic material fraction, a second magnetic separating device adapted to separate a second ferromagnetic material fraction, a conveying device adapted to supply a conveying stream to the first magnetic separating device, a further conveying device adapted to supply the conveying stream to the second magnetic separating device, wherein the conveying device and the further conveying device are arranged such that redistribution and/or reallocation of the material of the conveying stream takes place between the first magnetic separating device and the second magnetic separating device and that the conveying direction of the conveying device extends at an angle $\alpha$ of greater than 90° to the conveying direction of the further conveying device, wherein the second magnetic separating device is at least in part arranged below the further conveying device, facing away from the first magnetic separating device and the second magnetic separating device is a rotatable magnetic drum, an eddy current separating device configured to separate, after the second separation at least one non-magnetic and electrically conductive third material fraction from the conveying stream, the eddy current separating device being arranged in such a way that conveying current from the second magnetic separating device can be transferred or discharged to the eddy current separating device and the eddy current separating device has portions located below the second magnetic separating device, facing away from the first magnetic separating device.

12. The apparatus according to claim 11, wherein the apparatus is a mobile, movable unit.

13. The apparatus according to claim 11, further comprising one or more of: a metering hopper device, the metering hopper device having a feed opening configured to feed the feed material, and the metering hopper device having at least one, adjustable, metering opening.

14. The apparatus according to claim 13, further comprising a metering device configured to convey the conveying stream at least in regions below the metering hopper device, wherein the stream is conveyed below the metering opening and/or facing away from a feed opening, and the metering device is a belt feeder or a hopper discharge belt.

15. The apparatus according to claim 14, wherein the conveying device is arranged in such a way that the conveying stream can be transferred from the metering device to the conveying device, wherein the conveying device a conveyor belt or an accelerating belt.

16. The apparatus according to claim 11, wherein the first magnetic separating device is an overband magnetic separator, the first magnetic separating device being arranged above the conveying device in a region of the belt transfer between the conveying device and the further conveying device and/or in the region of the belt end of the conveying device facing away from the metering device.

17. The apparatus according to claim 11, wherein the further conveying device is arranged in such a way that the conveying stream can be transferred or discharged from the conveying device to the further conveying device, the further conveying device being arranged at least in regions below the conveying device, facing away from the first magnetic separating device, and/or the further conveying device is a vibrating chute or a conveyor belt.

18. The apparatus according to claim 11, wherein one or more of:

the conveying stream can be discharged from the further conveying device onto the second magnetic separating device, the second magnetic separating device is arranged in and/or on the further conveying device at the end of the further conveying device, and facing away from the belt transfer.

19. The apparatus according to claim 11, further comprising at least one air separator configured to separate a fourth material fraction, wherein the air separator is arranged in such a way that the conveying stream and/or the third material fraction can be transferred from the eddy current separating device to the air separator and/or wherein the air separator is arranged between the conveying device and the further conveying device in the region of the belt transfer.

20. The apparatus according to claim 11, further comprising at least one, height-adjustable, metering device which is arranged in and/or on a metering hopper device, wherein the metering is a metering roller and/or as a slide and/or pivotable flap.

21. The apparatus according to claim 11, further comprising a frame located at least regionally on an outside of the apparatus, and is configured to arrange, fasten and/or support individual, modular, components of the apparatus.

22. The apparatus according to claim 11, further comprising a bearing system configured to support the apparatus, bearing system arranged on an underside of the apparatus, facing a base, and/or wherein at least one axle, is fastened to the bearing with system with wheels thereon, and/or wherein at least one drawbar is attached to the bearing system and/or wherein at least one, extendable, support is provided on the bearing system.

23. The apparatus according to claim 11, wherein the apparatus is a trailer and/or that individual components of the apparatus are modular.

24. The apparatus according to claim 11, wherein the apparatus is configured such that the cross-section of the conveying stream in the conveying direction increases from a beginning to an end, from a region of the inlet of the conveying stream to a region of the outlet of the conveying stream from the apparatus.

* * * * *